US005883962A

United States Patent [19]

Hawks

[11] Patent Number: 5,883,962

[45] Date of Patent: Mar. 16, 1999

[54] METHOD AND APPARATUS FOR SPATIALLY ENHANCING STEREO AND MONOPHONIC SIGNALS

[75] Inventor: Timothy J. Hawks, Palo Alto, Calif.

[73] Assignee: Binaura Corporation, Menlo Park, Calif.

[21] Appl. No.: 848,402

[22] Filed: May 8, 1997

Related U.S. Application Data

[62] Division of Ser. No. 491,138, Jun. 15, 1995, Pat. No. 5,692,050.

[51] Int. Cl.[6] ..... H04R 5/00

[52] U.S. Cl. ..... 381/1

[58] Field of Search ..... 381/1, 11, 17–23, 381/27, 59, 61–63, 96–98

[56] References Cited

U.S. PATENT DOCUMENTS

| | | | |
|---|---|---|---|
| 4,356,349 | 10/1982 | Robinson | 381/1 |
| 4,868,878 | 9/1989 | Kunugi et al. | 381/1 |
| 5,274,708 | 12/1993 | Fields et al. | 381/17 |
| 5,384,851 | 1/1995 | Fujimori | 381/17 |
| 5,414,774 | 5/1995 | Yumoto | 381/63 |
| 5,434,921 | 7/1995 | Dombrowski, Jr. et al. | 381/1 |
| 5,572,591 | 11/1996 | Numazu et al. | 381/1 |
| 5,657,391 | 8/1997 | Jyosako | 381/1 |
| 5,671,287 | 9/1997 | Gerzon | 381/17 |
| 5,677,957 | 10/1997 | Hulsebus | 381/1 |
| 5,692,050 | 11/1997 | Hawks | 381/1 |
| 5,724,429 | 3/1998 | Banerjea | 381/1 |

FOREIGN PATENT DOCUMENTS

| | | | |
|---|---|---|---|
| 0412752 | 2/1991 | European Pat. Off. | 381/17 |
| 574145 | 12/1993 | European Pat. Off. | 381/17 |
| 2677839 | 12/1992 | France | 381/1 |
| 3118704 | 12/1982 | Germany | 381/1 |
| 53-116101 | 10/1978 | Japan | 381/63 |
| 62-163499 | 7/1987 | Japan | 381/1 |
| 3-163999 | 7/1991 | Japan | 381/17 |
| 4-79600 | 3/1992 | Japan | 381/17 |
| 4-128896 | 4/1992 | Japan | 381/63 |
| 86/01363 | 2/1986 | WIPO | 381/17 |

*Primary Examiner*—Paul Loomis
*Assistant Examiner*—Xu Mei
*Attorney, Agent, or Firm*—William L. Paradice, III

[57] ABSTRACT

A method and apparatus is disclosed which spatially enhances stereo signals without sacrificing compatibility with monophonic receivers. In accordance with one embodiment of the present invention, a stereo enhancement system is implemented using only two op-amps and two capacitors and may be switched between a spacial enhancement mode and a bypass mode. In other embodiments, simplified stereo enhancement systems are realized by constructing one of the output channels as the sum of the other output channel and the input channels. In other embodiments, a pseudo-stereo signal is synthesized and spatially enhanced according to stereo speaker crosstalk cancellation principles. In yet other embodiments, the respective spacial enhancements of monophonic signals and stereo signals are integrally combined into a single system capable of blending, in a continuous manner, the enhancement effects of both.

5 Claims, 21 Drawing Sheets

METHOD AND APPARATUS FOR SPATIALLY ENHANCING STEREO AND MONOPHONIC SIGNALS

This is a division of application Ser. No. 08/491,138 filed Jun. 15, 1995, now U.S. Pat. No. 5,692,050.

BACKGROUND OF THE INVENTION

1. Field of the Invention

The present invention relates generally to acoustic signals and particularly to a method and system for enhancing monophonic and stereophonic acoustic signals.

2. Description of Related Art

It is impossible to achieve the same degree of channel separation in a typical two loud-speaker stereo system that is possible with a pair of headphones. In such a stereo system, acoustic signals arriving at a listener's ear from the left and right loud-speakers which are in phase tend to add, while those which are out of phase tend to cancel one another. This phenomena, known as speaker crosstalk, degrades the perceived spatial and directional qualities of the acoustic image. Further, since speaker crosstalk is a function of the geometry of the interfering wavefronts resulting from the intersection of the left and right acoustic signals, the effects of speakers crosstalk are dependent upon the location of the listener relative to the positions of the left and right speakers. That is, the effects of crosstalk as perceived at one location may be different from those perceived at another location. This positional dependence of crosstalk gives rise to the so-called "dead spots" and "sweet spots" a listener experiences when moving across a listening area.

It is theoretically possible to cancel crosstalk by enhancing the stereo signals as a function of the particular positions of the speakers and the dynamic position of the listener. In practice, however, such cancellation is impossible to achieve since the particular arrangement of a listener's speakers and the dynamic position of the listener cannot be predicted. Numerous stereo enhancement systems have been disclosed recently which attempt to compensate for this positional dependence of crosstalk by enhancing the (L−R), or difference, component and the (L+R), or sum, component of the stereo signals. Such systems, however, are relatively complex and expensive to implement.

Further, many of the conventional stereo enhancement systems fail to effectively address the monophonic aspects of stereo signals. For instance, it is desirable in a stereo enhancement system to retain compatibility with monophonic receivers, that is, receivers which receive only the modified sum (L+R) component of the stereo signal. Receiving only the modified sum component without the ability to extract the spatial effects encoded into the difference signal results in an undesirable degradation of the original monophonic acoustic image.

In addition, since many of the presently broadcast and recorded acoustic images include both stereo and monophonic sources, it is also desirable for a stereo enhancement system to not only spatially enhance monophonic acoustic images but also to have the ability to smoothly and automatically transition between stereo signal enhancement and monophonic signal enhancement.

SUMMARY

A method and apparatus is disclosed which spatially enhances stereo signals without sacrificing compatibility with monophonic receivers. In accordance with one embodiment of the present invention, a stereo enhancement system is implemented using only two op-amps and two capacitors and may be switched between a spacial enhancement mode and a bypass mode. In other embodiments, simplified stereo enhancement systems are realized by constructing one of the output channels as the sum of the other output channel and the input channels. In other embodiments, a pseudo-stereo signal is synthesized and spatially enhanced according to stereo speaker crosstalk cancellation principles. In yet other embodiments, the respective spacial enhancements of monophonic signals and stereo signals are integrally combined into a single system capable of blending, in a continuous manner, the enhancement effects of both.

DETAILED DESCRIPTION OF THE INVENTION

It is to be understood that in the detailed discussion that follows, components common to the various embodiments and drawing figures are appropriately labelled with the same notations.

Before discussing aspects of the present invention in detail, it is necessary to mention several important underlying principles. First, audio enhancement systems should be channel symmetric in order to preserve the centering of the original stereo signal. That is, the left and right channels of the audio signal should be identically processed such that a reversing of the inputs to the audio enhancement system would not effect the operation of the system.

Figure 1A:
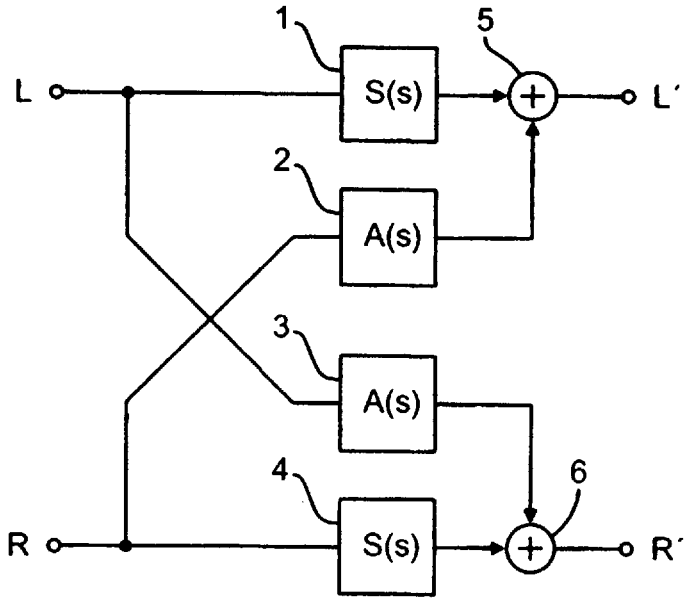
FIG. 1*a* is block diagram illustrating a conventional lattice signal flow topology.

Channel-symmetric audio enhancement systems are typically implemented using either a lattice topology or a shuffle topology. FIG. 1*a* illustrates the signal flow in a lattice topology, where L and R represent the left and right channel input signals respectively, and L' and R' represent the left and right output signals respectively. In such a lattice topology, each of the output signals is a sum of its respective input signal times a linear transfer function S(s) and the opposite input signal times a linear transfer function A(s). That is:

$$L'=S(s)L+A(s)R$$

$$R'=S(s)R+A(s)L$$

In order to maintain channel symmetry, the transfer functions S(s) of filters 1 and 4 must be identical, and the transfer functions A(s) of filters 2 and 3 must be identical.

Figure 1B:
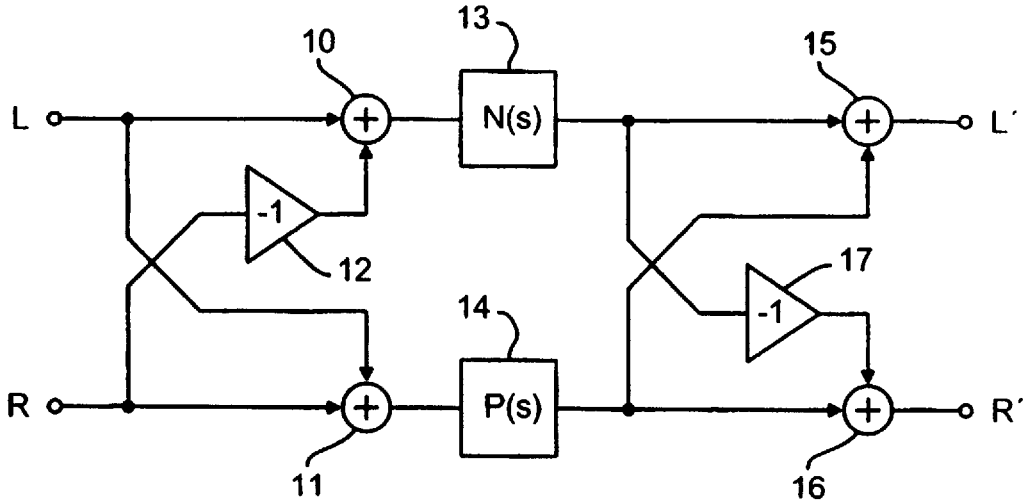
FIG. 1*b* is block diagram illustrating a conventional shuffle signal flow topology.

FIG. 1*b* illustrates the signal flow in a shuffle topology, where the output signals L' and R' are determined as follows:

$$L'=P(s)(L+R)+N(s)(L-R)$$

$$R'=P(s)(L+R)-N(s)(L-R) \quad (1)$$

Hence, a sum of input signals L and R, (L+R), is constructed at summing element 11 and processed through a filter 14 having a transfer function P(s). A difference of input signals L and R, (L−R), is constructed at summing element and processed through a filter 13 having a transfer function N(s). The processed difference signal is inverted at inverter 17 and recombined with the processed sum signal at summing elements 15, 16, to produce output channels L' and R'.

The transfer functions associated with the lattice and shuffle topologies of FIGS. 1*a* and 1*b*, respectively, are related to one another as follows:

$$S(s)=P(s)+N(s) \text{ and } A(s)=P(s)-N(s)$$

This relationship allows an audio enhancement system implemented in one topology to be easily converted to the other topology.

Further, it is desirable for an audio enhancement system to be sum invariant so as to be compatible with monophonic receivers. A sum invariant topology is that which the sum, or (L+R), component of the stereo signal is not altered such that the sum of the left and right input signals L, R equals the sum of the left and right output signals, L', R', as expressed below:

$$L'+R'=L+R \quad (2)$$

The lattice topology of FIG. 1*a* is sum-invariant, where the transfer functions S(s) and A(s) are related as follows:

$$S(s)+A(s)=1$$

The shuffle topology of FIG. 1*b* can be made sum-invariant by constraining transfer function P(s) such that:

$$P(s)=½$$

Figure 2A:
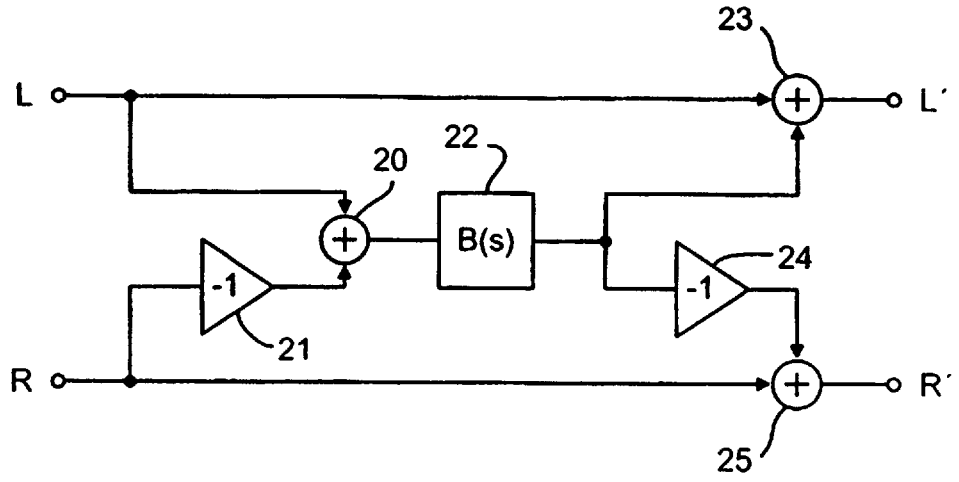
FIG. 2*a* is a block diagram illustrating a conventional sum-invariant signal flow topology.

Applicant has found that in some instances a sum-invariant topology such as that shown in FIG. 2*a* may offer a more efficient implementation of a stereo enhancement system. Referring to FIG. 2*a*, the right signal R is inverted at inverter 21 and combined with the left input signal L at summing element 20 to produce a difference signal (L−R), which is then processed through a filter 22 having a transfer function B(s). The processed difference signal (L−R) is summed with the original left input signal L at summing element 23 to produce the left output signal L'. The processed difference signal (L−R) is inverted at inverter 24 and summed with the original right input signal R at summing element 25 to produce the right output signal R'. The relationship between the input signals L, R and output signals L', R' may be expressed as follows:

$$L'=L+B(s)(L-R)$$

$$R'=R-B(s)(L-R) \quad (3)$$

The transfer function B(s) is related to the transfer function A(s) used in the lattice topology illustrated in FIG. 1*a* as follows:

$$B(s)=-A(s) \quad (4)$$

Reaaranging the sum-invariant relationship expressed in equation (2) above gives:

$$R'=L+R-L' \quad (5)$$

Figure 2B:
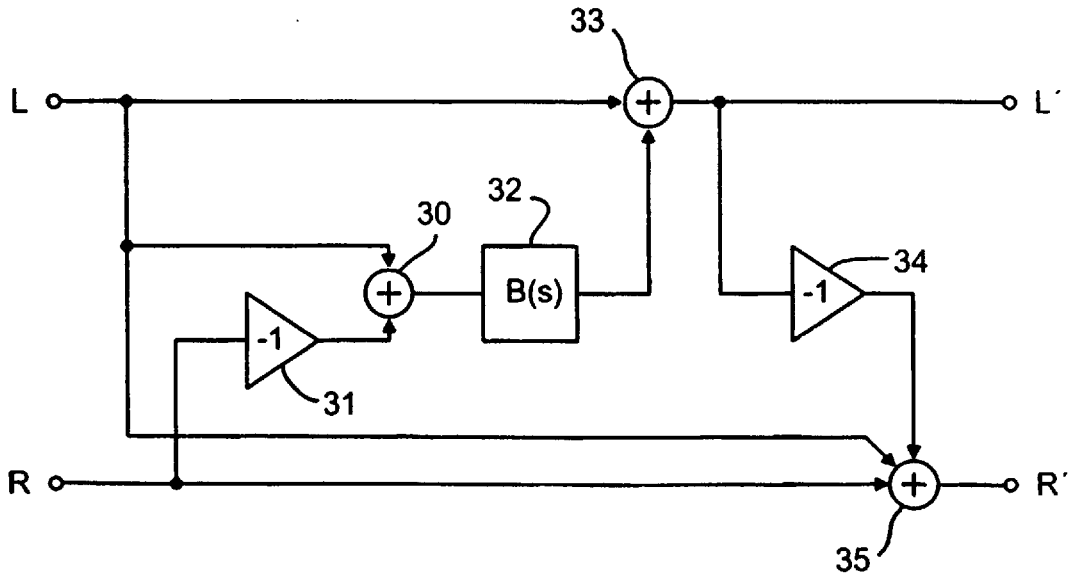
FIG. 2*b* is a block diagram illustrating a sum-invariant topology of a stereo enhancement system in accordance with the present invention.

This relationship has led Applicant to a modified sum-invariant topology, as illustrated in FIG. 2*b*, where the right output signal R' is constructed by subtracting the left output signal L' from the sum (L+R) of the input signals. Thus, the right input signal R is inverted at inverter 31 and summed with the left input signal L at summing element 30. The resultant difference signal (L−R) is processed by filter 32 having the transfer function B(s) and recombined with the original left input signal L at summing element 33. The left output signal L' is inverted at inverter 34 and summed with the original right R and left L input signals at summing element 35 to produce the right output signal R'. The advantages resulting from the sum-invariant topology of FIG. 2*b* will be apparent shortly.

Figure 3A:
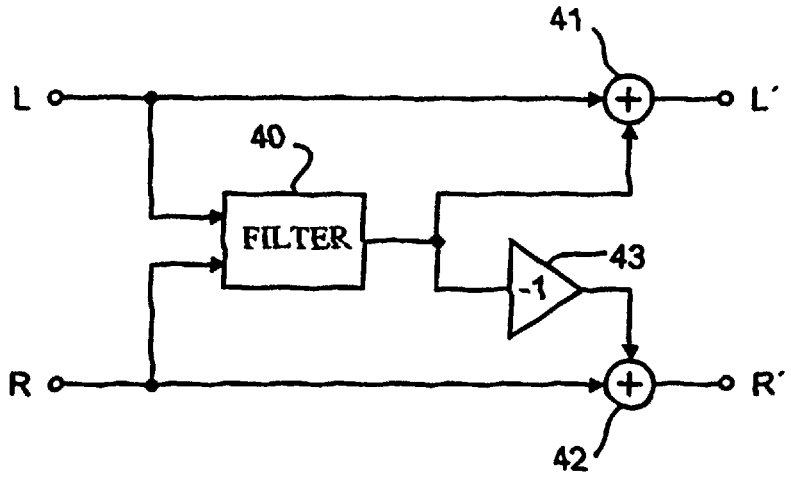
FIGS. 3*a* and 3*b* are block diagrams illustrating other sum-invariant topologies in accordance with the present invention.
Figure 3B:
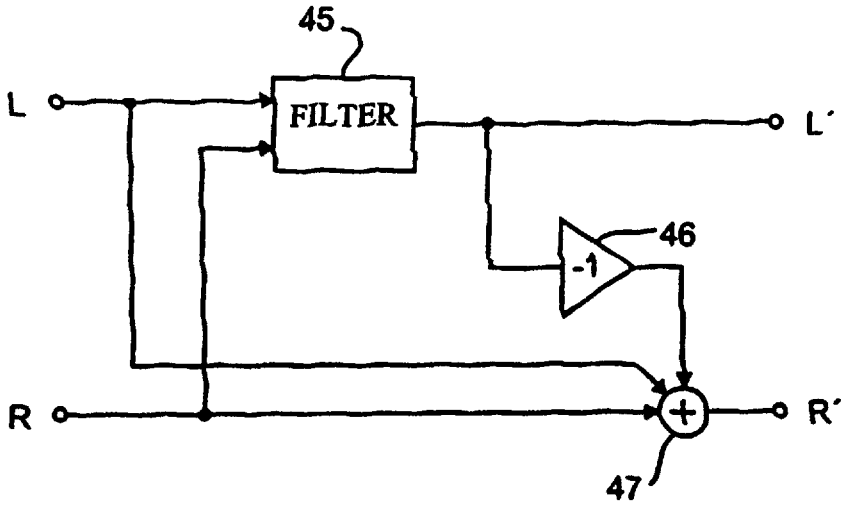

It should be noted that where channel symmetry is not a requirement of the particular enhancement system, as is the case when constructing pseudo-stereo signals from a monophonic signal, the topologies of FIGS. 2*a* and 2*b* may be broadened as illustrated in FIGS. 3*a* and 3*b*, respectively. Taking the topology shown in FIG. 3*a*, the left L and right R signals are combined and processed in function block 40 which may implement either a linear or non-linear function. This processed signal is added to the left input signal L at summing element 41 to produce the left output signal L' and subtracted from the right input signal R via inverter 43 and summing element 42 to produce the right output signal R'. The processing performed by filter 40 may be any suitable signal shaping function of one or both of the input signals L, R.

Referring to FIG. 3*b*, the processing function of filter 45 may be any suitable signal shaping function of one or both of the two input signals L, R. The output signal of filter 45 is provided as the left output signal L', while the right output signal R' is produced by subtracting the left output signal L' from the sum (L+R) of the input signals.

The shuffle topology (FIG. 1*b*) is generally preferred over the lattice topology (FIG. 1*a*) since the shuffle topology requires only two filters 13–14, where the lattice topology requires four filters 1–4. Nevertheless, Applicant has found that the lattice topology allows for a simpler circuit implementation of a stereo enhancement system.

Figure 4:
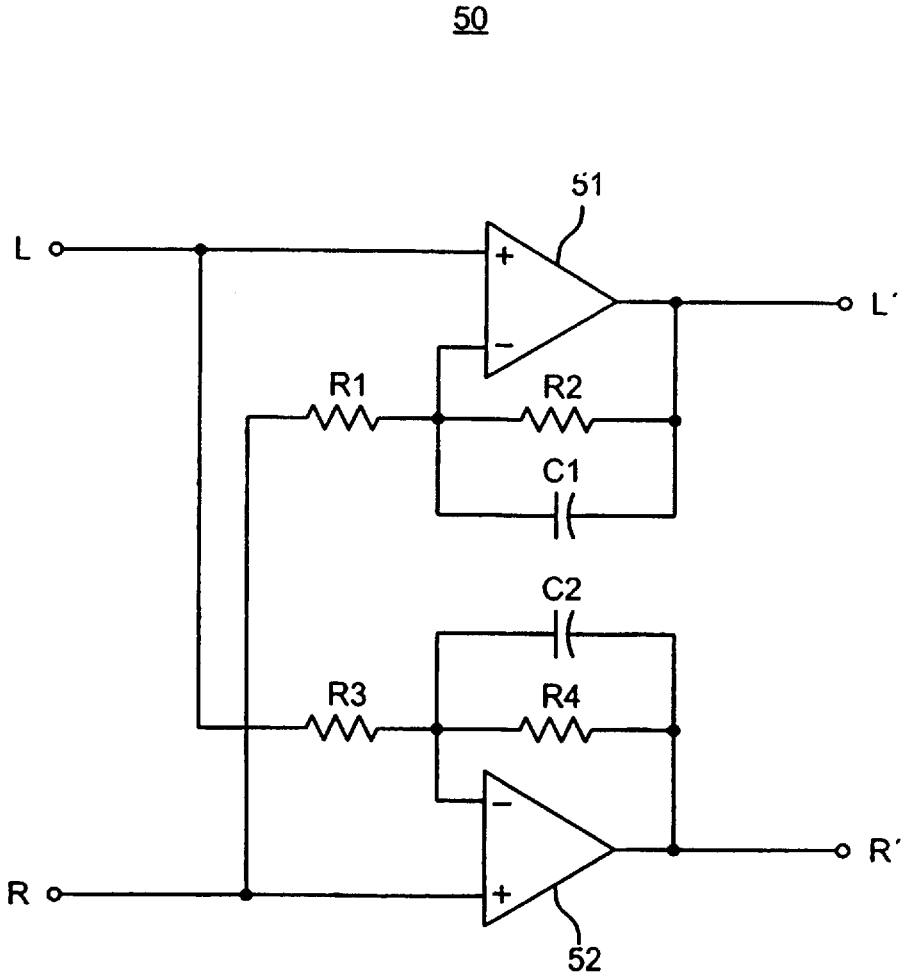
FIG. 4 is a schematic diagram of a stereo enhancement system in accordance with one embodiment of the present invention.

FIG. 4 shows a stereo enhancement system 50 in accordance with one embodiment of the present invention. Enhancement system 50, the design of which stems from the lattice topology of FIG. 1*a*, requires only two op-amps 51, 52. The left input signal L is provided to the positive input of op-amp 51 and to the negative input of op-amp 52 via resistor R3, while the right input signal R is provided to the positive input of op-amp 52 and to the negative input of op-amp 51 via resistor R1. Op-amps 51 and 52, which are configured as a leaky integrator, respectively combine the left L and right R input signals as follows:

$$L' = \left(1 + \frac{A_0}{1 + s\tau_P}\right) L - \frac{A_0}{1 + s\tau_P} R$$

$$R' = \left(1 + \frac{A_0}{1 + s\tau_P}\right) R - \frac{A_0}{1 + s\tau_P} L$$

where $A_0$ is the gain of the bass frequency boost and $\tau_P$ is the time constant of the transfer function which determines the roll-off frequency of the boost. The values of $A_0$ and $\tau_p$, which are in the preferred embodiment approximately 3.125 and 600 $\mu$s (corresponding to a frequency of 265 Hz), respectively, may be set according to the following:

$$A_0 = \frac{R2}{R1} = \frac{R4}{R3} \text{ and } \tau_P = R2 \cdot C1 = R4 \cdot C2$$

Since the top and bottom halves of enhancement system 50 are symmetric, the values of resistors R1, R2, and capacitor C1 may in some embodiments be equal to the values of R3, R4 and capacitor C2, respectively. The values for the above-mentioned resistors and capacitors may, in actual embodiments, vary depending upon the operating characteristics of the selected op-amp, noise and input impedance considerations, and cost and size restrictions of discrete capacitors C1 and C2, as is well understood in the art. In a preferred embodiment, op-amps 51 and 52 are low noise audio-grade op-amps such as the TL074, available from Texas Instruments.

In contrast to some conventional audio enhancement systems, enhancement system 50 of FIG. 4 does not boost or otherwise alter the high-frequency portions of the difference (L−R) signal, i.e., those portions above approximately 1100 Hz. As a result, the embodiment of FIG. 4 achieves a superior balance between centered and off-centered acoustic images in the source signal than do those conventional systems which provide more power to the high-frequencies of the difference (L−R) signal. It should also be noted that the embodiment of FIG. 4 does not alter the sum (L+R) signal, thereby preserving monophonic acoustic images and retaining compatibility with monophonic receivers. Although contrary to numerous prior teachings of crosstalk cancellation which suggest modifying the sum component, Applicant feels that the relatively small acoustic advantages realized from modifying the sum signal are outweighed by the benefits of sum-invariance, i.e., retaining monophonic compatibility.

The operation of enhancement system 50 of FIG. 4 may be also be described in terms of the shuffle topology of FIG. 1*b* and the sum-invariant based topologies of FIGS. 2*a*, 2*b*. In the case of a shuffle topology, the transfer functions N(s) and P(s) are of the form:

$$N(s) = 0.5\,\frac{N_0 + s\tau_P}{1 + s\tau_P} \text{ and } P(s) = 0.5$$

where $N_0$ is the gain of the bass frequency boost and $\tau_P$ is the time constant which determines the roll-off frequency of the boost. In the preferred embodiment, the corresponding values of $N_0$ and $\tau_P$ should be approximately 7.25 and a $\tau_P$ of about 600 $\mu$s, respectively. Setting P(s) equal to one-half ensures sum-invariance, as described above.

Figure 5A:
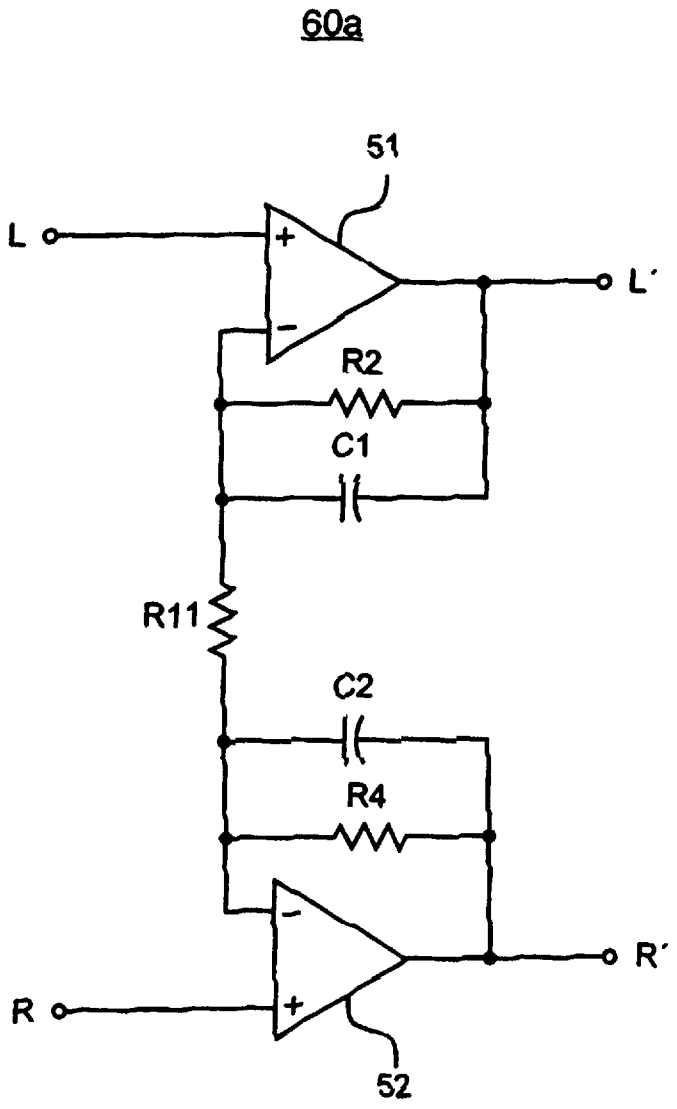
FIGS. 5*a*, 5*b*, 6, and 7 are schematic diagrams of stereo enhancement systems in accordance with other embodiments of the present invention.

The virtual short between the inputs of op-amps 51 and 52 allows the negative inputs of respective op-amps 51 and 52 to connected together via a resistor R11, as shown in FIG. 5*a*, thereby resulting in the elimination of one resistor. Enhancement system 60*a* of FIG. 5*a* operates in a manner similar to that of FIG. 4 and, accordingly, those components common to the embodiments of FIGS. 4 and 5*a* are similarly labelled. The simpler design of enhancement system 60*a* also allows the left and right input signals to be directly coupled to the positive inputs of op-amps 51 and 52, respectively. As a result, enhancement system 60*a* desirably exhibits a high input impedance. Resistors R2 and R4 must be equal and capacitors C1 and C2 must be equal. The values of $A_0$ and $\tau_p$ are determined as follows:

$$A_0 = \frac{R2}{R11} \text{ and } \tau_P = R2 \cdot C1$$

Note that parameters $A_0$ and $\tau_P$ may easily be adjusted by varying the resistance of resistor R11 which, in some embodiments, is a potentiometer.

Figure 5B:
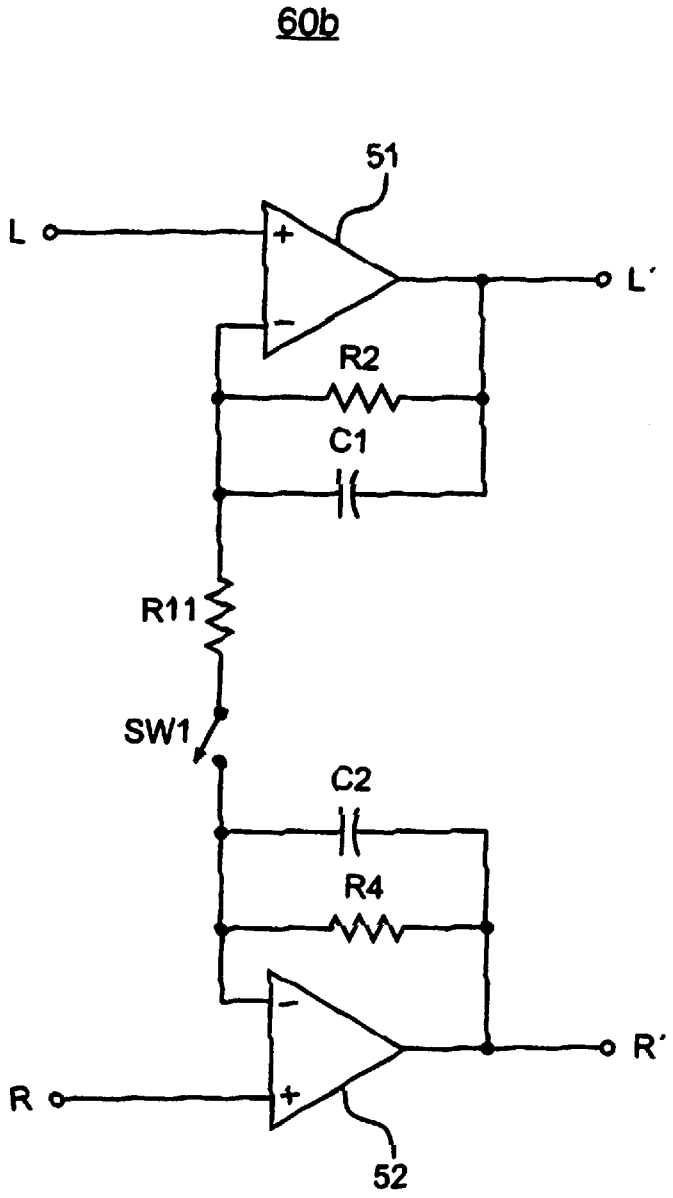

In yet another embodiment, a switch SW1 may be added in series with resistor R11 as shown in FIG. 5*b*. The resultant enhancement system 60*b* may thus switch between an enhancement mode, in which the left and right input signals L, R are enhanced as described above to produce enhanced left and right output signals L', R', and a bypass mode, in which the left and right input signals L, R pass unmodified through enhancement system 60 and appear as left and right output signals L', R'. Switch SW1 may be any suitable switching device. The low-pass filter nature of op-amps 51 and 52 desirably prevents instantaneous voltage changes between input signals and output signals. Thus, when switching between modes, the left and right output signals L', R' will exponentially converge to their respective input signals L, R as a function of the time constant $\tau_p$, thereby resulting in smooth switching transitions between modes. Accordingly, complex switching techniques which minimize switching noise, such as zero-crossing switching techniques, are unnecessary.

Figure 6:
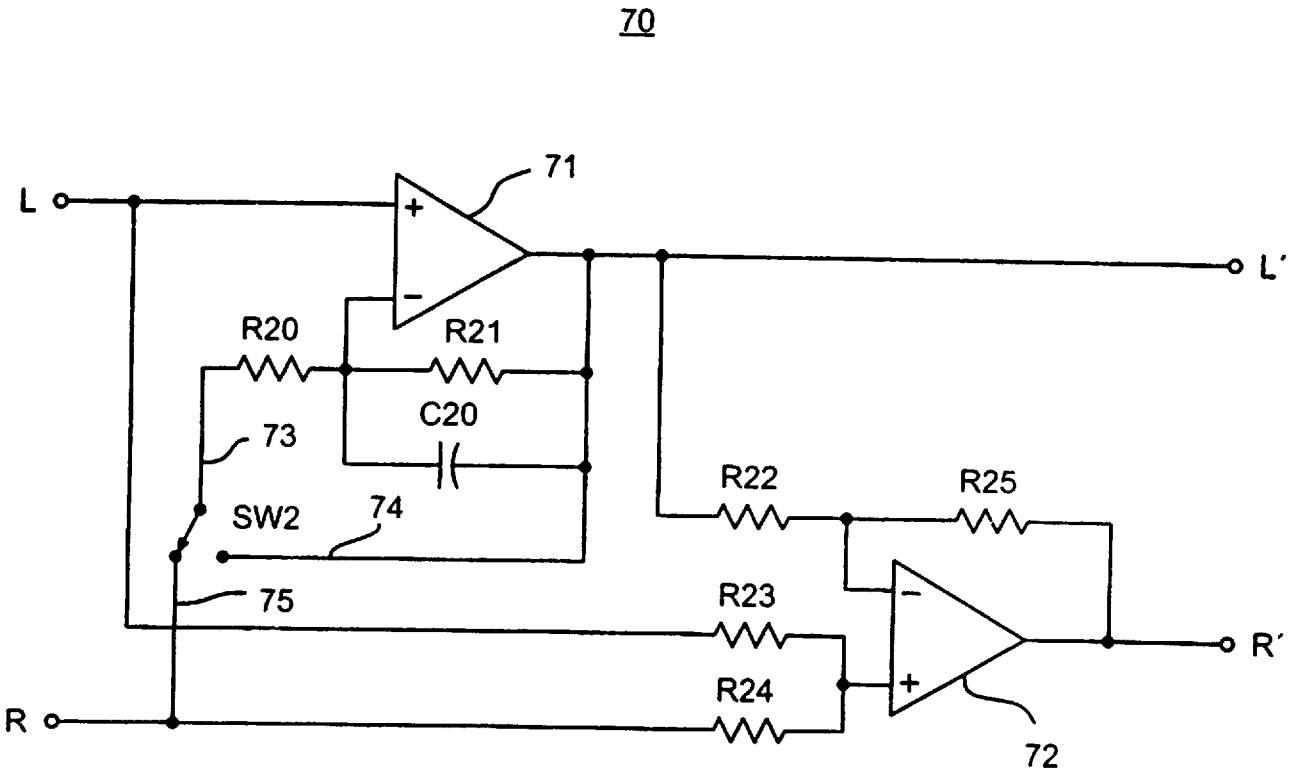

As mentioned earlier, the sum-invariant topologies depicted in FIGS. 2*a* and 2*b* may allow for an improved circuit implementation of stereo enhancement system in accordance with the present invention. Referring to FIG. 6, the design of enhancement system 70 is based upon the sum-invariant topology illustrated in FIG. 2*b*. The left output signal L' is produced through op-amp 71 and its associated feedback elements R21 and C20, which operate as a leaky integrator, from the sum of the left and right input signals (L+R). The right output signal R' is constructed according to equation (5), i.e., op-amp 72 sums the left output signal L' with the input signal sum (L+R) to produce the right output signal R'. In order to ensure proper summing at op-amp 72, resistors R23 and R24 should be of equal value, and resistors R22 and R25 should be of equal value. Note that the sum-invariant design of enhancement system 70 requires only one capacitor C20, as opposed to the two capacitors required in the embodiments of FIGS. 4 and 5. Switch SW2 allows the enhancement system 70 to switch between enhancement and bypass modes as previously described with respect to FIG. 5.

Enhancement system 70 operates according to the aforementioned B(s) transfer function, $$B(s) = \frac{B_0}{1 + s\tau_P} \tag{7}$$

where $$B_0=0.5(N_0-1) \quad (8)$$

The $B_0$ and $\tau_p$ parameters are determined as follows:

$$B_0=\frac{R21}{R20} \text{ and } \tau_P=R21\cdot C20$$

Preferably, the values of $B_0$ and $\tau_p$ are approximately 3.125 and 600 $\mu$s, respectively. With the exception of the above mentioned constraints, the values of the resistors contained in enhancement system 70 may vary depending upon desired operating characteristics. Note that since capacitor C20 prevents the voltage at the negative input of op-amp 71 from changing instantaneously, voltage continuity of the left output signal L' is preserved when switching between modes via switch SW2. Thus, when enhancement system 70 is switched from enhancement to bypass mode, op-amp 71 acts as a voltage follower, with the output voltage offset by the voltage across C20. Capacitor C20 will gradually discharge through the parallel combination of resistors R20 and R21. When switch SW2 switches from bypass to enhancement mode, capacitor C20 is exponentially charged, thereby preserving the voltage continuity of the output and minimizing switching impulse energy. Resistors R20, R21 and capacitor C20 determine the time constant of exponential transients caused when switching between modes. Line 74 serves primarily as a shunt to prevent parasitic coupling between lines 73 and 75 from producing any unwanted residual effect in bypass mode. Where not necessary, line 74 may be removed such that capacitor C20 discharges only through R21.

Figure 7:
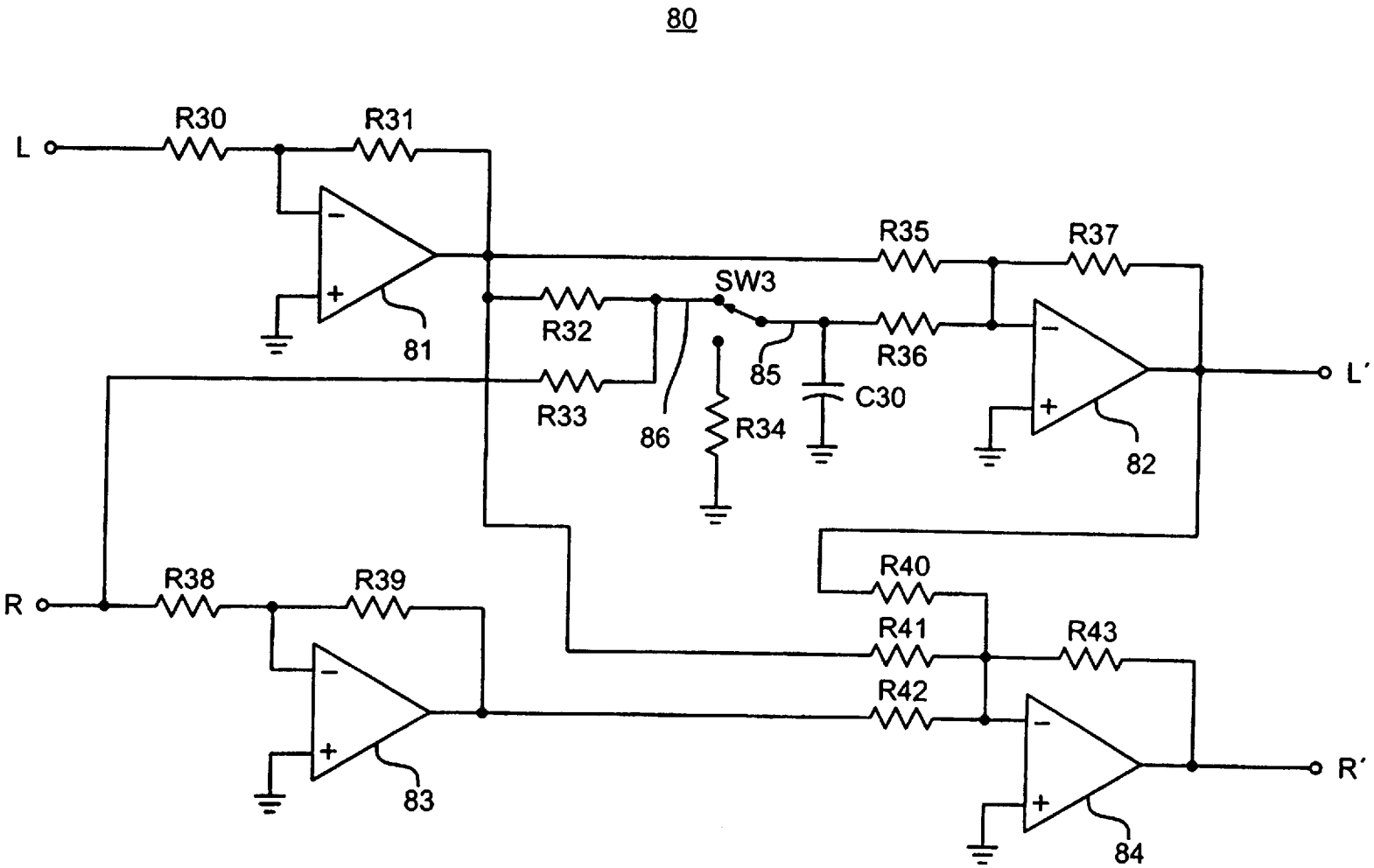

The embodiments described above with reference to FIGS. 4–6 employ a minimum number of op-amps in order to minimize implementation cost. The distortion and fidelity associated with enhancement system 70 may be improved by modifying enhancement system 70 to employ op-amps which operate only in an inverting mode. Such a modification is illustrated in FIG. 7 as stereo enhancement system 80. Op-amp 81 and resistors R30, R31 invert the left input signal L, and op-amp 83 and resistors R38, R39 invert the R input signal, where R30=R31 and R38=R39. Op amp 84 and associated resistors R40–R43 produce the right output signal R' according to the sum-invariant constraint of Equation (5). Resistors R40–R43 should be of equal value to ensure proper summing at op-amp 84. Op-amp 82 and associated capacitor C30 and resistors R32–R37 produce the left output signal L' according to Equations (3) and (7), where the $B_0$ and $\tau_p$ parameters, which are preferably 3.125 and 600 $\mu$s, respectively, govern the selection of other component values as follows:

$$8\tau_P B_O = R37\cdot C30$$

$$R32=R33=\frac{R37}{2B_0}$$

$$R36=\frac{R37}{4B_0}$$

$$R35=R37$$

As stated earlier with reference to other embodiments, the precise values of the components employed in enhancement system 80 may vary depending upon desired operating characteristics. Resistors R32, R33 and R36 are related radiometrically to R37. Switch SW3 switches enhancement system 80 between enhancement and bypass modes. When SW3 connects lines 85 and 86, enhancement system 80 enters enhancement mode and operates as described above. When switch SW3 connects line 85 to ground via resistor R34, enhancement system 80 enters bypass mode. In this mode, op-amp 82 operates as an inverter and provides a left output signal L' equal to the left input signal L. It follows, then, that the L' signal and inverted L signal cancel at op-amp 84 such that the right output signal R' is equal to the right input signal R. Capacitor C30 helps to ensure voltage continuity between modes as discussed previously. When switching from enhancement to bypass mode, C30 completely discharges to ground through the parallel combination of resistors R36 and R34. While not necessary to the operation of system 80, the path to ground through resistor R34 helps to eliminate parasitic coupling. When switching from bypass to spatialization mode, C30 gradually charges in the normal course of operation.

The embodiments described above with reference to FIGS. 4–7 are advantageous over prior enhancement systems based upon the shuffle topology in that the voltages of the internal nodes of the embodiments of FIGS. 4–7 will not exceed the maximum input voltage or maximum output voltage. Conversely, in shuffle topology based enhancement systems, the internally generated sum (L+R) and difference (L−R) signal voltages may be twice that of the maximum input signals, thereby requiring either (1) halving the voltage range of the input signals or (2) dividing the sum (L+R) and difference (L−R) signals by a factor of two. The former alternative undesirably limits the range of compatible input signal levels, while the latter alternative undesirably reduces the signal to noise ratio (by as much as 6 dB).

The above described embodiments can easily be implemented with a digital signal processor. The pole and zero frequencies used in the above transfer functions are a small fraction of typical audio sample rates. Thus, the bilinear transformation can be used to derive a discrete time version. As is well understood in the art of digital signal processing, the bilinear transformation is a useful approximation which relates the s-plane of the Laplace transform to the discrete-time z-plane as follows:

$$s=\frac{2}{T}\;\frac{1-z^{-1}}{1+z^{-1}}$$

where T is the reciprocal of the signal sampling rate. As an example, this can be applied to the B(s) transfer function used in the sum-invariant topologies as follows:

$$B(z)=\frac{B_0}{1+\frac{2}{T}\tau_P}\;\frac{1+z^{-1}}{1+\frac{1-\frac{2}{T}\tau_P}{1+\frac{2}{T}\tau_P}z^{-1}}$$

Using a sample rate of 44.1 kHz and the parameter values disclosed above, the above expression reduces as follows:

$$B(z)=0.057956\frac{1+z^{-1}}{1-0.962908z^{-1}}$$

An efficient approach to computing a spatially enhanced data sample can be obtained by using the signal flow illustrated in the topology of FIG. 2*a* in conjunction with the above-denoted B(z). It is to be understood that a particular topology which yields the greatest efficiency in an analog implementation does not necessarily yield the most efficient digital implementation. For instance, in analog implementations, the number of inverting and summing operations significantly affects implementation cost, while the number of signals added or inverted in a particular operation has only a slight impact upon implementation cost. In a digital implementation, on the other hand, the total number of summing operations is a function of the total number of signals so summed minus the number of summing operations. Further, negations typically impose no additional overhead. As a result, the sum-invariant topology of FIG. 2*a* is probably preferable over that of FIG. 2*b* for the digital implementation of stereo enhancement systems in accordance with the present invention. It should be further noted that the most economical DSP implementation may depend upon the architecture of the particular digital signal processor used. Nonetheless, a sum-invariant based DSP implementation will usually be superior to those based upon either the lattice or shuffle topologies. It is to be understood, however, that circuit designs based upon each of the above described topologies can be easily mapped from the analog domain to the discrete-time digital domain.

In accordance with other embodiments of the present invention, a system is disclosed which spatially enhances not only stereo signals but also monophonic signals in a manner similar to those previously described. A complete understanding of these other embodiments requires an appreciation of some basic principles used in the conversion of monophonic signals to pseudo-stereo signals.

It is well understood that a pseudo-stereo signal may be synthesized from a monophonic signal (e.g., a signal in which the right and left channels are identical) by spatially "placing" the sound towards either the left or right channel in a selective manner dependent upon the frequency of the monophonic input signal. Such a synthesis may be accomplished by first modifying the input signal and then adding and subtracting this modified signal to and from, respectively, the original input signal to produce left and right channels which are different.

Figure 8A:
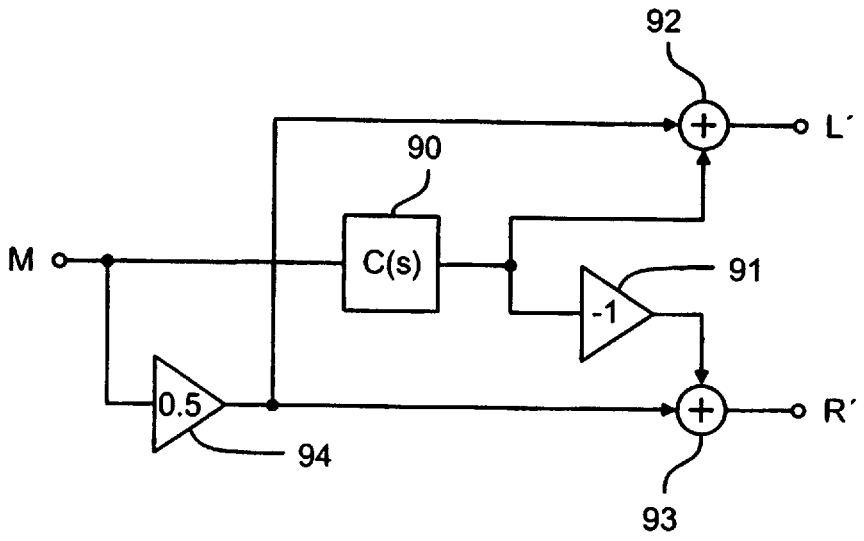
FIGS. 8*a* and 8*b* are block diagrams illustrating conventional pseudo-stereo topologies.
Figure 8B:
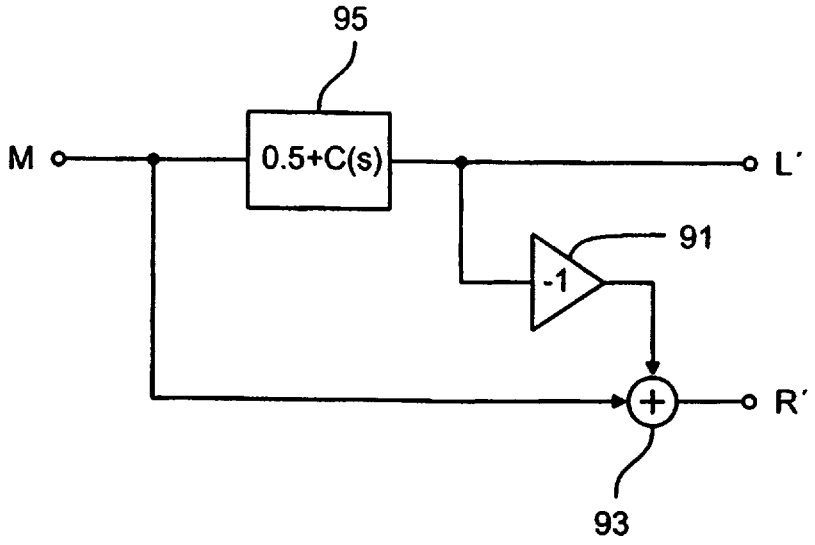

For instance, FIGS. 8*a* and 8*b* illustrate two common topologies for such synthesis. Referring first to FIG. 8*a*, the monophonic input signal M is routed through an all-pass filter 90 having a transfer function C(s). The output of filter 90 is alternately added to, via summing element 92, and subtracted from, via inverter 91 and summing element 93, attenuated replicas of the original input signal M to produce left L' and right R' pseudo stereo signals, respectively. The relationship between output signals L', R' and the input signal M may be expressed as follows:

$$L'=M(0.5+C(s))$$

$$R'=M(0.5-C(s))$$

where C(s) is an all-pass transfer function of the following form:

$$C(s)=C_0\frac{(1-s\tau_1^*)(1-s\tau_2^*)}{(1+s\tau_1)(1+s\tau_2)}\cdots\frac{(1-s\tau_n^*)}{(1+s\tau_n)}$$

Typically, the time constants $\tau_1$–$\tau_n$ will, in actual implementations, naturally occur in complex conjugate pairs. The constant $C_0$ determines the "depth" of the pseudo-stereo effect. This effect is maximized when $C_0$ is equal to either 0.5 or −0.5. At these values of $C_0$, certain frequencies will appear exclusively in one of the output channels. The sign of $C_0$ is somewhat arbitrary, since reversing the sign is merely equivalent to swapping the L' and R' channel outputs of FIG. 8*a*. The number of crossover points, that is, the number of particular frequencies at which the energies in the left and right channels are equal, is determined by the order of C(s). Note that the gain element 94 of FIG. 8*a* is not essential, but rather has been included to aid in understanding embodiments of the present invention which later follow. This also allows the FIG. 8*a* topology to meet the following criterion:

$$L'+R'=M$$

which implies that the topology will be sum-invariant if the M input signal is constructed by summing left L and right R input signals.

The topology illustrated in FIG. 8*b*, which operates in a manner identical to that of the topology of FIG. 8*a*, may provide a more economical implementation in certain cases.

The pseudo-stereo topologies illustrated in FIGS. 8*a* and 8*b* suffer from a couple of drawbacks. If $C_0$ is chosen to achieve maximum depth, i.e., equal to either 0.5 or −0.5, the contrast between left and right channels may be too extreme and lead to a "deaf-in-one-ear" phenomenon. This undesirable effect may be minimized by increasing the order of the all-pass filter transfer function C(s). Such a remedy, however, results in an increased implementation cost. This deaf-in-one ear phenomenon may minimized by simply reducing the value of $C_0$ in order to provide a more acoustically plausible spread of the input signal. Reducing $C_0$, however, will cause a decrease in the phase difference between the left and right channels and, therefore, will diminish the perceived spaciousness of the acoustic image. In other words, reducing $C_0$ undesirably allows speaker crosstalk to cancel out-of-phase energy in the bass frequencies.

In accordance with the present invention, Applicant has found that the deaf-in-one-ear phenomenon may be minimized, without significantly diminishing spaciousness, in one of two ways. In the first approach, a modified C(s) transfer function may be implemented, where C(s) is re-defined as:

$$C'(s)=C_0\frac{(1-s\tau_z)(1-s\tau_1^*)(1-s\tau_2^*)}{(1+s\tau_p)(1+s\tau_1)(1+s\tau_2)}\cdots\frac{(1-s\tau_n^*)}{(1+s\tau_n)}$$

such that $$|C_0|\frac{\tau_z}{\tau_p}>\frac{1}{2}\text{ and }\tau_p>\tau_z$$

where $\tau_p$ and $\tau_z$ are real, positive and lie in the same bass frequency range as does the $\tau_p$ used in the earlier described stereo enhancement systems. The modified transfer function C'(s) exhibits a bass frequency boost and, by dominating the output, allows a greater separation between channels for bass frequencies than for higher frequencies. While achieving satisfactory results, such an approach undesirably results in a large power level discrepancy between the monophonic input signal M and the pseudo-stereo output signals L', R'. It is to be noted that prescaling the monophonic input signal M does not provide an effective solution for reasons that will later become apparent.

Figure 9A:
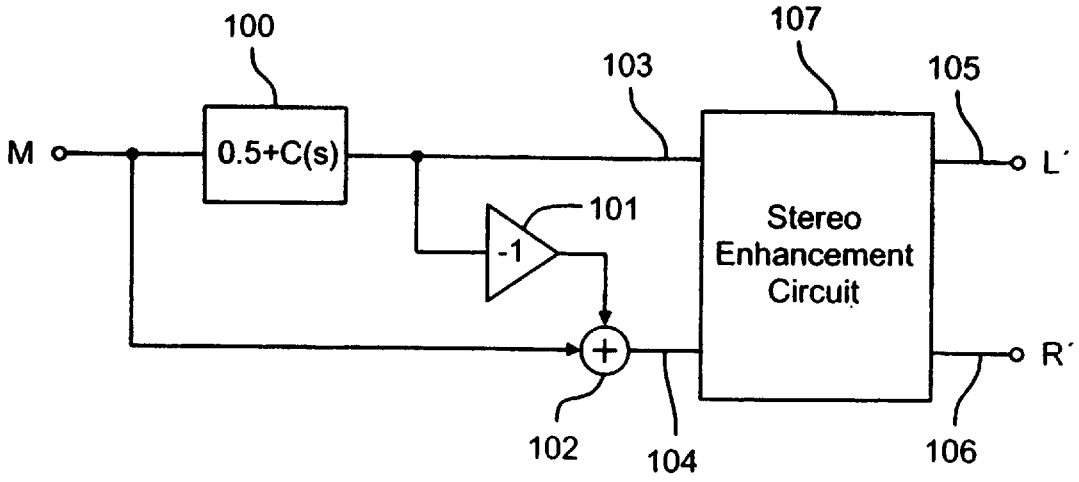
FIGS. 9*a* and 9*b* are block diagrams illustrating pseudo-stereo enhancement topologies in accordance with the present invention.

In the second and preferred approach, one of the pseudo-stereo synthesis topologies illustrated in FIGS. 8*a* and 8*b* may be cascaded with the stereo enhancement systems described above in accordance with the present invention, as illustrated in FIG. 9*a*. In this stereo/mono enhancement topology, filter 100 creates the pseudo-stereo left channel on line 103 while inverter 101 and summing element 102 create the pseudo-stereo right channel on line 104. A stereo enhancement system 107 enhances these pseudo-stereo channel signals to produce left and right output signal L', R' on lines 105 and 106, respectively. System 107 may be any suitable one of the stereo enhancement systems previously described in accordance with the present invention. Note that since each of previously described embodiments of stereo enhancement systems are channel-symmetric, the particular channel assignment to system 107 is arbitrary. It is to be understood that although the pseudo-stereo portion of the topology of FIG. 9*a* is based upon the topology of FIG. 8*b*, it may in other embodiments be based upon the topology of FIG. 8*a*.

Figure 9B:
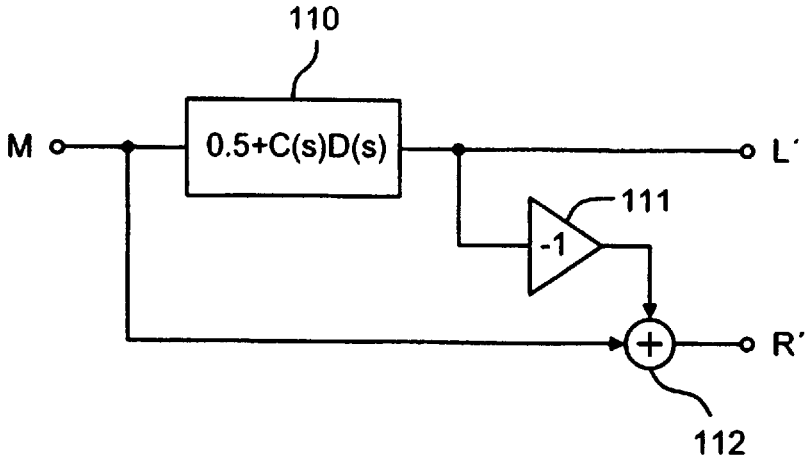

Using the sum-invariant relationship R'=L+R−L', the stereo/mono enhancement topology of FIG. 9*a* may be simplified to that of FIG. 9*b*, where transfer function D(s) represents the enhancement function performed by system 107 in the topology of FIG. 9*a*. The outputs L' and R' are related to input M as follows:

$$L'=M(0.5+C(s)D(s))$$

$$R'=M(0.5-C(s)D(s))$$

D(s) is defined as follows:

$$D(s)=\frac{D_0+s\tau_P}{1+s\tau_P} \tag{9}$$

where $D_0$ is the DC gain of D(s). The D(s) transfer function may be related to the B(s) transfer function utilized in previous embodiments as follows:

$$D(s)=1+2B(s)$$

and thus $$D_0=1+2B_0$$

It follows that the monophonic input signal M is related to the left L' and right R' output signals as follows:

$$L'=M(0.5+C(s)(1+2B(s)))$$

$$R'=M(0.5-C(s)(1+2B(s)))$$

Since the pseudo-stereo (L−R) difference signal tends to be more sensitive to excessive bass frequency boost than does a typical stereophonic (L−R) difference signal, the boost associated with a pseudo-stereo enhancement system should be somewhat lower than that of a pure stereo enhancement system such as those described earlier. Applicant has chosen $D_0$ to be equal to just over half of $2B_0+1$, i.e., approximately 4.5. The time constant $\tau_p$ is, as mentioned previously, approximately equal to 600 $\mu$s. The particular order of transfer function C(s) involves a tradeoff between superior sound quality (higher order) and implementation cost (lower order). In a preferred embodiment to be described shortly, C(s) is implemented in a manner so as to have three poles and zeroes, an order which Applicant believes achieves a satisfactory compromise between sound enhancement and implementation cost. The preferred time constants for the three poles and zeroes are 46$\mu$s, 67$\mu$s and 254$\mu$s, respectively, which are all real. Applicant has found that a value of 0.2 for the constant $C_0$ results in an optimal tradeoff between deep separation and shallow subtlety.

Figure 10A:
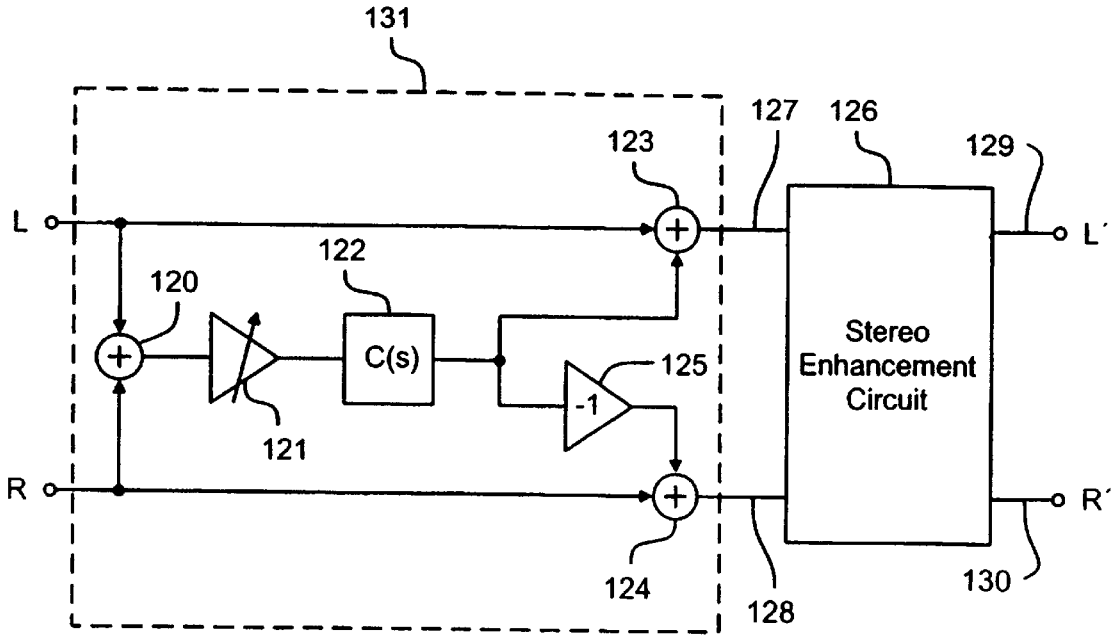
FIGS. 10*a*, 10*b*, 11*a*, 11*b*, 12, 13, and 14 are block diagrams illustrating stereo/mono enhancement topologies in accordance with the present invention.

In typical audio applications, the nature of the received signal (i.e., whether stereophonic or monophonic) is usually not known. In some instances, such as FM radio transmissions, the received signal may vary between a stereophonic and monophonic nature. Thus, it would be desirable to provide a mechanism capable of not only enhancing both the stereo and mono signals but also of smoothly switching between such modes. In accordance with the present invention, a pseudo-stereo synthesis system 131 may be cascaded with stereo enhancement system 126 as illustrated the topology in FIG. 10*a*. It is to be understood that stereo enhancement system 126 may be any of the previously described stereo enhancement systems. Where the input signal is of a monophonic nature, e.g., where the left input signal L is identical to the right input signal R, the topology of FIG. 10*a* will operate in a manner identical to that of the topology of FIG. 9*a*. The gain of a variable gain element 121 may be varied between zero and unity in response to an external control signal (not shown) such as a stereo blend signal received from an FM stereo decoder or a stereophonic source detection circuit or even a user control. When gain element 121 is set to have a gain of zero, the pseudo-stereo synthesis portion 131 is effectively disabled such that the operation of the topology of FIG. 10*a* is determined solely by stereo enhancement system 126. Thus, variable gain element 121 allows for the dynamic control of the depth of the pseudo-stereo synthesis effect. Note that it is possible, with the appropriate choice of parameters, to fix the gain of variable gain element 121 at unity for all signal sources.

In practice, most stereo sources contain sufficient out-of-phase channel information to effectively mask the pseudo-stereo effect, while any monophonic components present will benefit from the pseudo-stereo effect. Thus, if a stereo signal contains very little spatialized information, i.e., a minimal difference (L−R) signal, the pseudo-stereo component will dominate the stereo component. Thus, for such a stereo signal, the pseudo-stereo effect will spatially enhance the corresponding acoustic image. Where variable gain element 121 has unity gain, the inputs and outputs of the topology of FIG. 10*a* may be related to one another as follows:

$$L'=L+B(s)(L-R)+C(s)(1+2B(s))(L+R)$$

$$R'=R-B(s)(L-R)-C(s)(1+2B(s))(L+R) \tag{10}$$

If variable gain element 121 is used to dynamically switch between modes, i.e., between enabling and disabling pseudo-stereo synthesis portion 131, certain measures will need to be taken to ensure low switching noise. For instance, the gain of variable gain element 121 should varied at such a rate so as not to introduce significant high-frequency energy into the acoustic signals.

In the topology of FIG. 10*a*, both pseudo-stereo input signals (synthesized from a monophonic input signal via portion 131) and stereophonic input signals are filtered via stereo enhancement system 126 and, thus, are processed according to the same previously disclosed parameters associated with the transfer function B(s). Since, however, pseudo-stereo signals generated from monophonic signals are different from pure stereophonic signals, it would be advantageous for each of such signals to be spatially enhanced according to different parameters while simultaneously enabling a blending of the two enhancement effects.

Figure 10B:
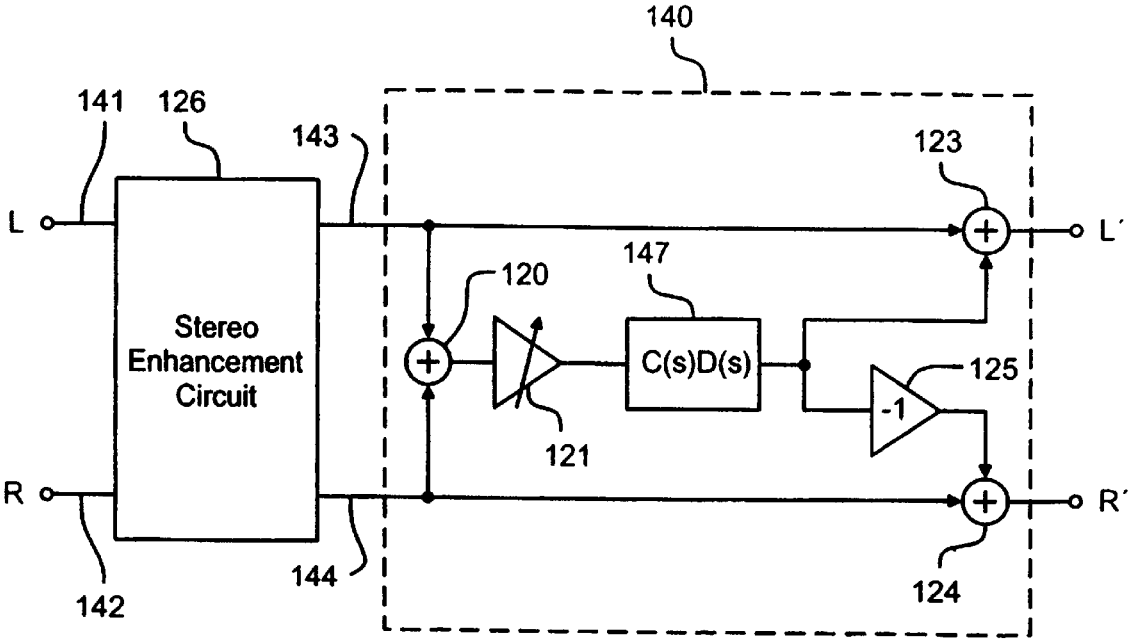

Thus, in accordance with another embodiment of the present invention, a pseudo-stereo synthesis system 140 is cascaded to the output lines 143, 144 of stereo enhancement system 126 as illustrated in the topology of FIG. 10*b*. In this topology, the stereo enhancement parameters and thus the spatially enhancing effect of stereo enhancement circuit 126 will affect only stereophonic signals received on input lines 141, 142 (since monophonic signals do not contain a (L−R) difference component, monophonic input signals received on lines 141, 142 pass unmodified through stereo enhancement system 126). These unmodified monophonic input signals are processed in pseudo-stereo synthesis system 140 by a filter 147 having a transfer function of C(s)D(s), where C(s) and D(s) synthesize and spatially enhance, respectively, the pseudo-stereo signal. The topology of FIG. 10*b* operates, in all other respects, in a manner identical to that of the topology of FIG. 10*a*. Where variable gain element is set to unity gain, the inputs and outputs of the topology of FIG. 10*b* may be related to one another as follows:

$$L'=L+B(s)(L-R)+C(s)D(s)(L+R)$$
$$R'=R-B(s)(L-R)-C(s)D(s)(L+R) \quad (11)$$

In a preferred implementation, D(s) is of the form disclosed in Equation (9), where $D_0$ and $\tau_p$ are approximately 4.5 and 600 $\mu$s, respectively.

Figure 11A:
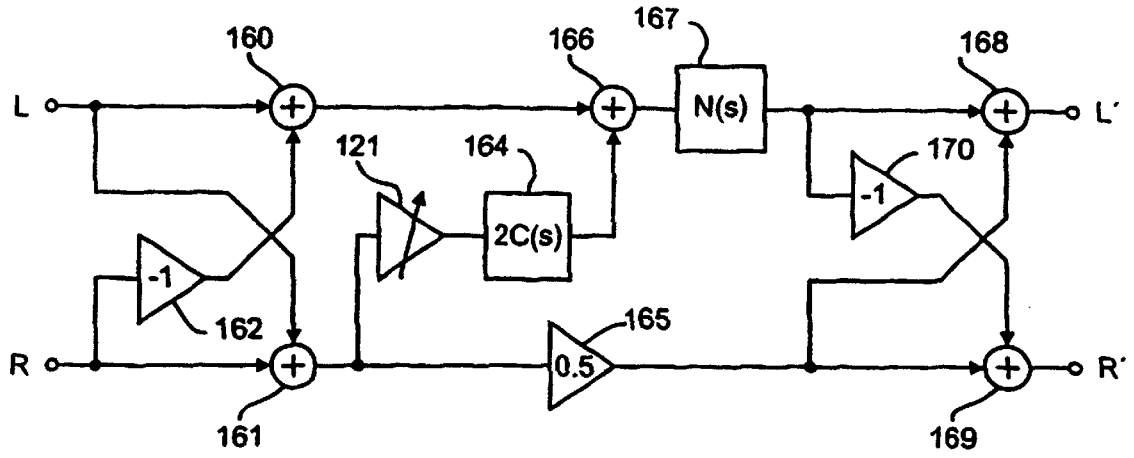
Figure 11B:
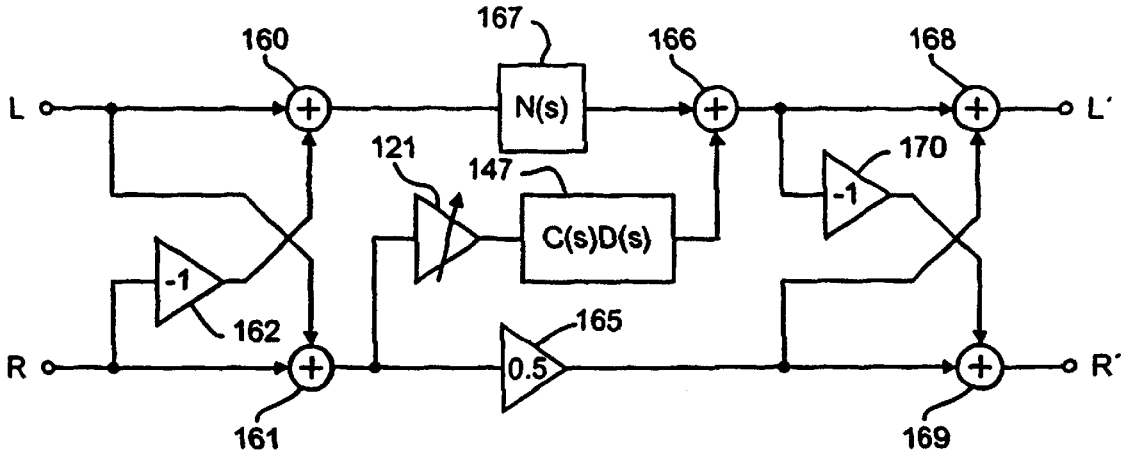

The topologies of FIGS. 10*a* and 10*b* may be modified so as to operate according to shuffle-style topologies as illustrated in FIGS. 11*a* and 11*b*, respectively. The topology of FIG. 11*a* uses the same enhancement filter 167, having a transfer function of N(s), in processing both stereo and pseudo-stereo signals. That is, like the topology of FIG. 10*a*, the topology of FIG. 11*a* uses the same parameters in spatially enhancing both stereo and pseudo-stereo signals. The function N(s) is of the form previously described with respect to FIG. 1*b*. Pseudo-stereo filter 164 operates according to the previously described transfer function C(s) multiplied by a factor of 2. Assuming that Equation (8) remains valid, the relationship between the inputs and outputs of the topology of FIG. 11*a* may be expressed according to Equation (10). In a manner similar to the topologies of FIGS. 10*a* and 10*b*, variable gain element 121 may be either manually or automatically controlled to accommodate a variety of types of input signals, or set to unity gain and still handle most monophonic and stereo input signals.

The topology of FIG. 11*b*, a modified version of the topology of FIG. 11*a*, utilizes distinct spatial enhancement parameters for stereo and pseudo-stereo signals in a manner similar to that described with respect to the topology of FIG. 10*b*. In the topology of FIG. 11*b*, unlike that of FIG. 11*a*, the pseudostereo signal is synthesized and spatially enhanced by filter 147 according to transfer functions C(s) and D(s), respectively, and summed with the enhanced stereo signal generated by filter 167 according to transfer function N(s). Again, transfer functions C(s), D(s), and N(s) are of the respective forms previously described.

Note that these topologies are advantageously sum-invariant notwithstanding the asymmetrical nature of pseudo-stereo transfer function C(s). It should also be noted that since monophonic input signals do not contain a (L−R) difference component, when such a monophonic signal is provided as an input to the topologies of FIGS. 11*a* and 11*b*, the (L−R) difference signal path (created by summing element 160) will contain no signal. Thus, the coupling of the (L+R) sum signal to the difference signal path via filter 164 and summing element 166 is vital in the construction of the left output signal L'.

Since the above topologies are sum-invariant, they may be modified to operate according to the sum-invariant topologies of FIGS. 3*a* and 3*b*, thereby resulting in more simplified and more cost-effective implementations. Further, Applicant has found that greater simplification may be achieved by setting the pole time constant of the D(s) transfer function equal to that of the B(s) transfer function. In this manner, the D(s) transfer function need not be explicitly implemented while advantageously providing distinct enhancement parameters for stereo and pseudo-stereo signals. Thus, the filter which would have otherwise implemented C(s)D(s) now need only implement C(s), thereby allowing for the elimination of one pole-determining capacitor. Note that this simplification results in the elimination of one delay element in digital implementations.

Figure 12:
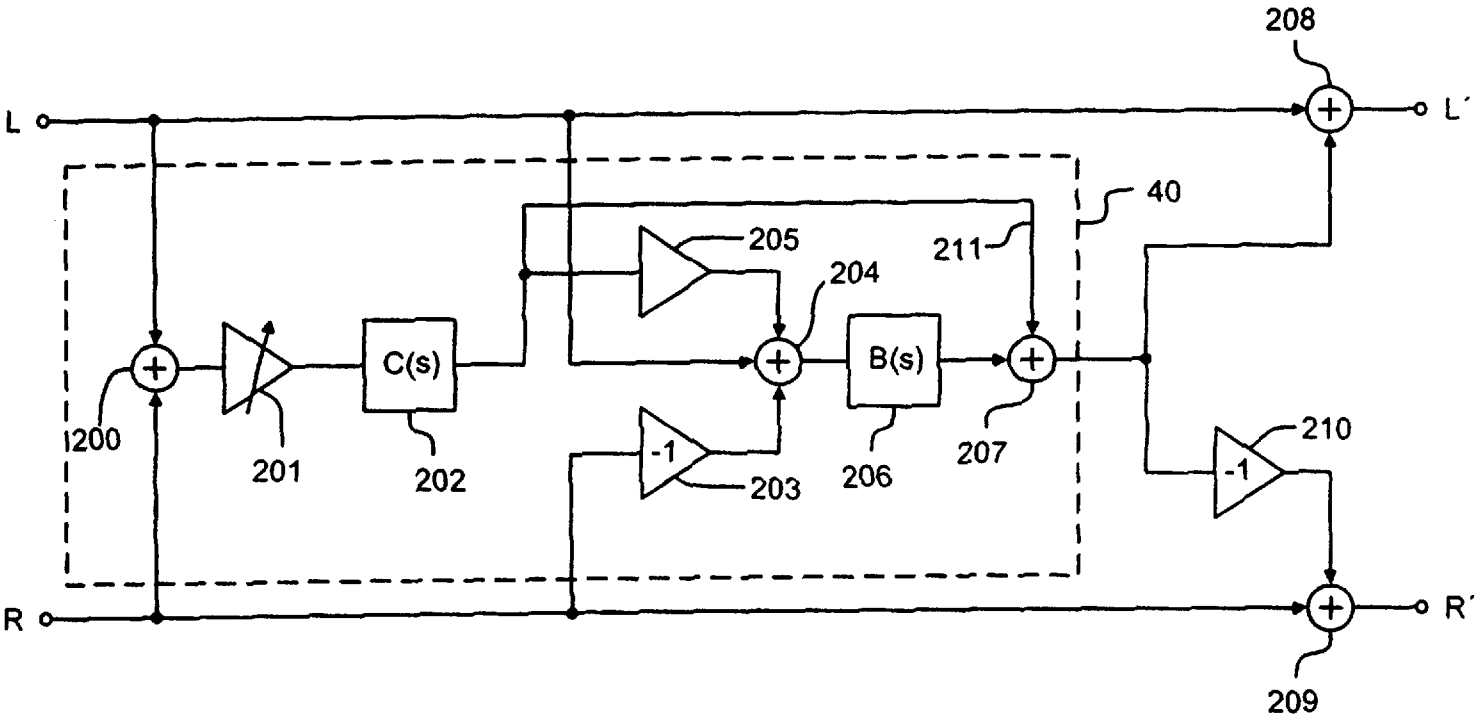
Figure 13:
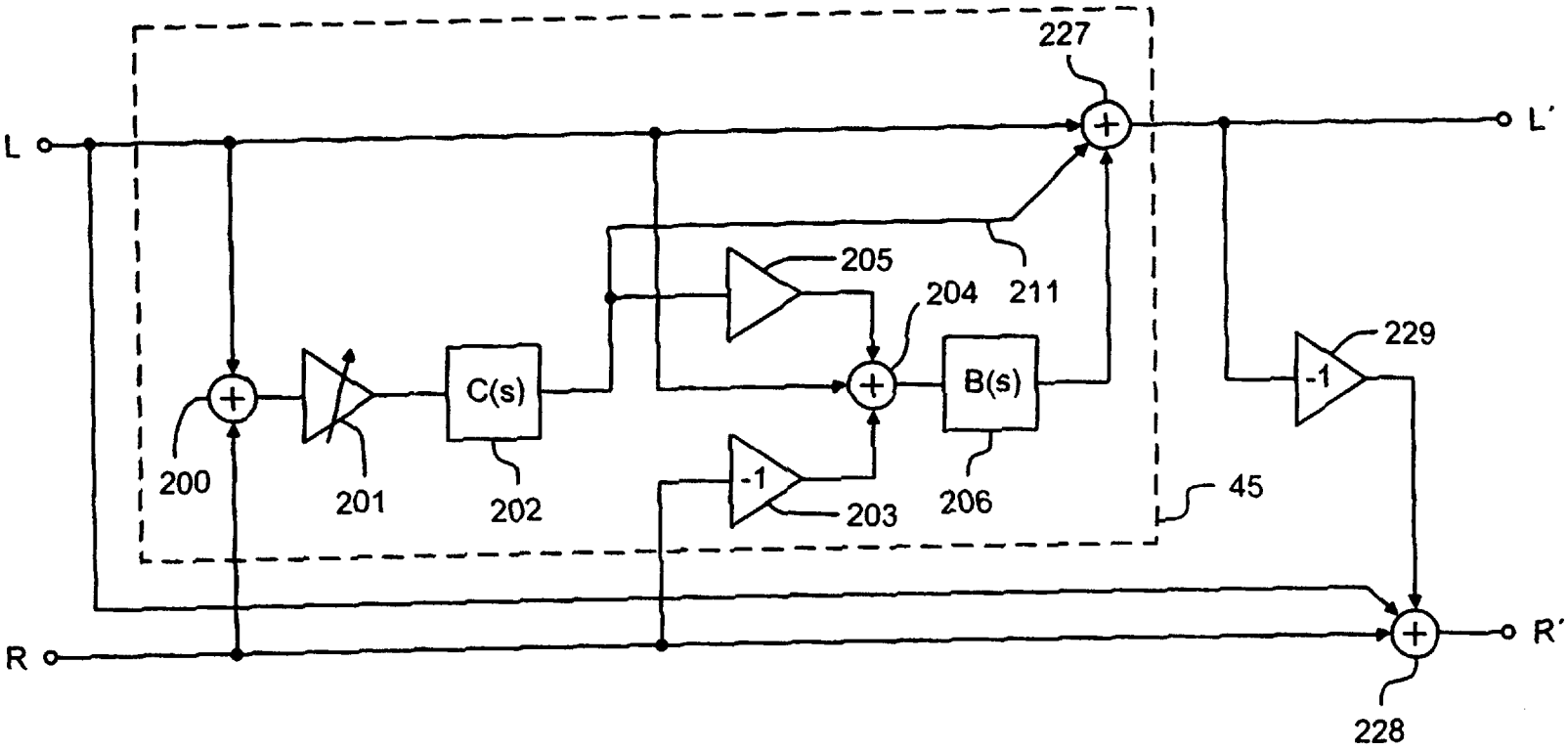

The resultant simplified topologies derived from the topologies of FIGS. 11*a* and 11*b* are illustrated in FIGS. 12 and 13, respectively. In the topology of FIG. 12, summing elements 208 and 209, along with inverter 210, replicate the style of the sum-invariant topology of FIG. 3*a*. Summing element 200, variable gain element 210, filter 202 having a transfer function C(s), and gain element 205, construct the pseudo-stereo signal. The magnitude of the signal output from filter 202 will, to a significant degree, determine the magnitude of the pseudo-stereo synthesis at those frequencies significantly above the pole of transfer function B(s), i.e., significantly above 265 Hz. The magnitude of the signal output from gain element 205 will determine the magnitude of the pseudo-stereo synthesis at DC. Thus, the effect of the previously described transfer function D(s) is emulated by the addition of signals at summing elements 204 and 207. The constant $D_0$ of the emulated transfer function D(s) is preferably approximately 4.5 and may be set as follows:

$$G_{205}=\frac{D_0-1}{B_0}$$

where $G_{205}$ is the gain of variable gain element 205. Where variable gain element 201 is set to unity, the left L' and right R' output signals of the topology of FIG. 12 are related to the left L and right R input signals according to Equation (11).

Note that in the topology of FIG. 12, it is possible to control the gain at any point along a given signal path and achieve identical results. For typical analog implementations, the inputs of a summing network are usually multiplied by some gain factor. Thus, there are several ways to ensure that the magnitude of signals provided to summing elements 204 and 207 from filter 202 are independently adjustable; so utilizing gain element 205 is only one of such ways. The stereo enhancement portion of the topology of FIG. 12 operates in a manner similar to that of the topology of FIG. 2*a*. Thus, the form and parameter values for transfer function B(s) and C(s) are preferably as stated previously.

The topology of FIG. 13 operates in a manner nearly identical to that of FIG. 12 with one notable exception. Inverter 229 and summing elements 227 and 228 are configured so as to replicate the sum-invariant style topology of FIG. 3*b*. Thus, other than the function of summing element 227, components within block 45 of the topology of FIG. 13 operate in an identical manner and perform the same function as those components in block 40 of the topology of FIG. 12.

Where it is desired to have distinct enhancement pole time constants for each of the pseudo-stereo synthesis and stereo signal enhancement functions, the topologies of FIGS. 12 and 13 may be modified by eliminating the signal path passing through gain element 205 and altering filter 202 to have a transfer function C(s)D(s).

Figure 14:
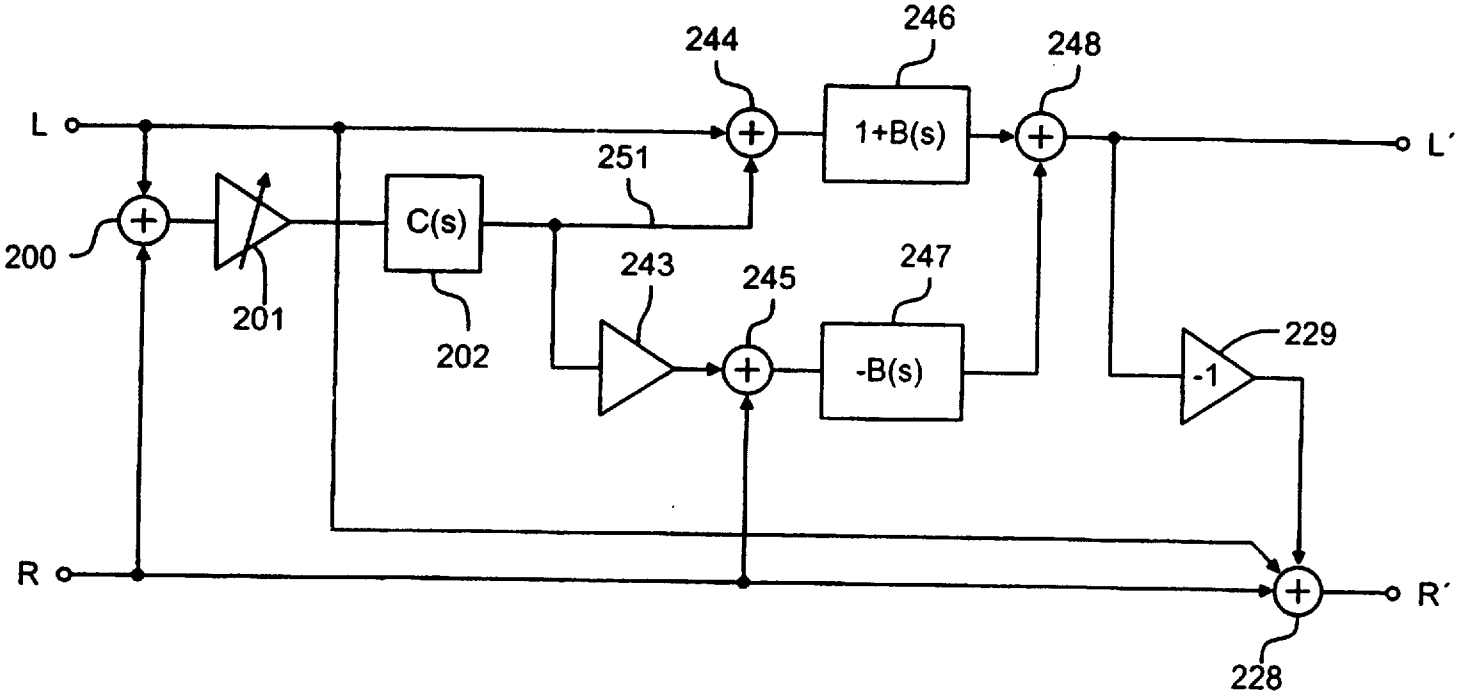

The topologies of FIGS. 12 and 13 may be further simplified, and thus implemented at a reduced cost, by slightly sacrificing the spatial attribute of the pseudo-stereo signal. Such a simplified topology is illustrated in FIG. 14, where the role of filters 246, 247 and summing element 248 may be performed in analog implementations by a single op-amp configured as a leaky integrator such as, for instance, op-amp 51 of stereo enhancement system 50 of FIG. 4. The left L' and right R' output signals and left L and right R input signals in the topology of FIG. 14 are related to one another as expressed by Equation (11), where gain element 241 is set to unity. However, the emulated D(s) transfer function will be of the form:

$$D(s)=1+B(s)(1-G_{243})$$

where $G_{243}$, the gain of gain element 243, must be less than unity. As a result, the range of $D_0$ is restricted as follows:

$$B_0+1 \geqq D_0 \geqq 1 \quad (12)$$

Where $G_{243}$ is zero, D(s) will achieve a maximum bass frequency enhancement. Accordingly, where $G_{243}$ equals unity, there will be no bass frequency enhancement. $G_{243}$ should be chosen such that:

$$G_{243} = \frac{B_0 + 1 - D_0}{B_0}$$

Although different applications may require slightly different parameter values, $G_{243}$ should preferably be zero in order to effect the maximum depth possible which, in turn, implies that $D_0$ should be approximately 4.125. The preferred form and associated parameter values for transfer functions B(s) and C(s) are as stated previously. In a manner similar to that of the topologies of FIGS. 12 and 13, the signals provided to summing elements 244 and 245 may be independently scaled.

Figure 15:
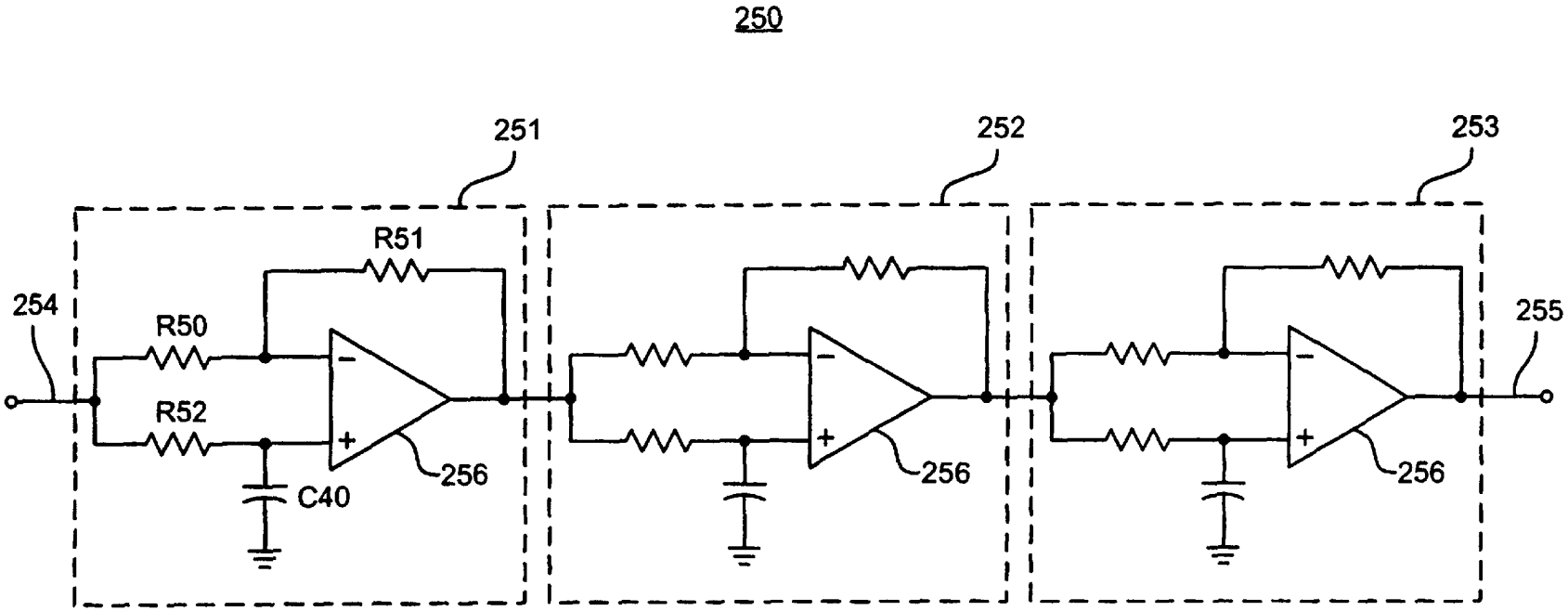
FIG. 15 is a schematic diagram illustrating an all-pass filter utilized in some embodiments of the present invention.

Implementing the above described stereo/mono enhancement topologies will, in actual embodiments, require an all-pass filter such as the conventional three-pole all-pass filter 250 illustrated in FIG. 15. All-pass filter 15 includes three cascaded single pole all-pass filters 251, 252, 253. Isolating each pole to a separate stage minimizes sensitivity to component variation. Note that the first filter 251 should be designed such that R50=R51. Filter 251 will have a transfer function H(s) and an associated pole time constant τ:

$$H(s) = \frac{1 - s\tau}{1 + s\tau} \text{ where } \tau = R52 \cdot C40$$

Filters 252 and 253 will also operate according to the above described transfer function H(s) where the associated time constants τ are determined in a similar manner.

In the preferred embodiments of the stereo/mono enhancement system that follow, the individual single pole filters 251–253 should be configured according to well known techniques such that resultant three-pole filter 250 has pole time constants of 46 μs, 67 μs and 254 μs. It is to be understood that a filter utilizing second or higher order sections may used in order to reduce the number of required op-amps. Further, second order filter sections allow for complex pole conjugate pairs. However, such second or higher order filter sections are more sensitive to component variation.

Figure 16:
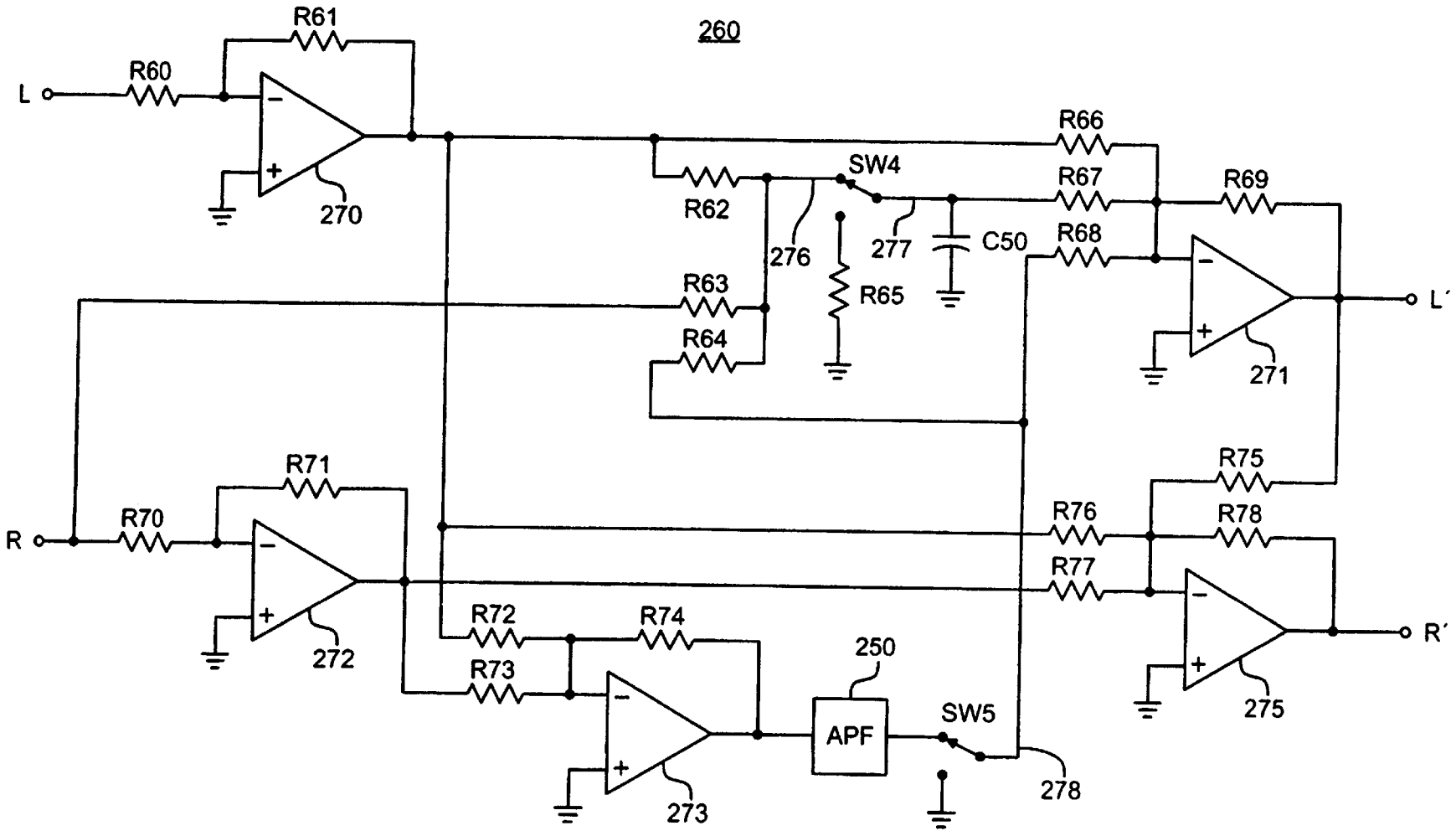
FIGS. 16–19 are schematic diagrams of stereo/mono enhancement systems in accordance with the present invention.

The preferred embodiment of the present invention is illustrated in FIG. 16. The operation of stereo/mono enhancement system 260 is based upon the topology of FIG. 13 and, accordingly, the discussion of the topology of FIG. 13 is equally applicable to system 260. Note that with the exception of op-amps 256 of all-pass filter 250, each of the op-amps in system 260 of FIG. 16 operates in an inverting mode for reasons discussed earlier. The left input signal L is inverted by op-amp 270 and associated resistors R60 and R61, while the right input signal R is inverted by op-amp 272 and associated resistors R70 and R71. These two inverted signals are scaled and summed at op-amp 273 to extract the monophonic signal component which is then delayed by all-pass filter 250 to produce a pseudo-stereo signal. When switch SW5 connects the output of filter 250 to line 278, the pseudo-stereo signal is summed with the inverted left input signal L and non-inverted right input signal R at the node common to resistors R62–R64. When switch SW4 connects lines 276 and 277, this sum signal is low-pass filtered by capacitor C50 according to the B(s) transfer function. This filtered signal is summed with the inverted left input signal L and the pseudo-stereo signal (synthesized by filter 250) at op-amp 271 to produce the left output signal L' output. Op-amp 275 subtracts the left output signal L' from the sum of the left L and right R input signals.

Switches SW4 and SW5 allow system 260 to operate in one of three possible modes. If switch SW4 connects line 277 to ground via resistor R65, the stereo enhancement filter, e.g., the B(s) function, is disabled. When switch SW5 connects line 278 to ground, thereby disabling the pseudo-stereo synthesis function of filter 250, e.g., function C(s), system 260 will operate in a bypass mode. In this mode, the left L and right R input signals appear unmodified as left L' and right R40 output signals, respectively. If, on the other hand, switch SW4 connects line 277 to line 276, the stereo enhancement filter B(s) is enabled. The operating mode of system 260 will now depend upon the position of switch SW5. If switch SW5 now connects line 278 to ground, thereby disabling the pseudo-stereo synthesis function C(s), system 260 operates in a stereo-only mode. If, however, switch SW5 connects filter 250 to line 278, thereby enabling the pseudo-stereo synthesis function C(s), system 260 operates in a dual stereo/mono mode and will spatially enhance both types of input signals.

As discussed with respect to system 80 of FIG. 7, the switching between bypass and stereo/mono enhancement modes via switch SW4 exhibits relatively low switching noise due to the low-pass filtering function of capacitor C50. The switching of switch SW5 may cause a discontinuity in the output signals. However, such a discontinuity is tolerable in most applications since the gain of the pseudo-stereo signal on line 278 is fairly low as compared to that of the stereo signals. In applications where such a discontinuity is unacceptable, the discontinuity may be minimized using well known zero-crossing switching techniques, or by replacing switch SW5 with a variable gain element controlled by a switching ramp signal.

The selection of appropriate values for the components contained in system 260 may vary depending on the particular application, the desired operating characteristics, and the types of components used. Note, however, that the following constraints should be met in order to realize the benefits of system 260. First, the resistors associated with summing/inverting op-amps 270, 272 and output op-amp 271 should be chosen such that:

R60=R61

R70=R71

R75=R76=R77=R78

Next, resistor R69 and capacitor C50 should chosen such that the product of their values is as follows:

$$4\tau_p(2B_0+K_1D_0)=R69 \cdot C50$$

After selecting an appropriate value for resistor R69, the remaining resistor values associated with op-amp 271 are determined as follows:

$$R62 = R63 = \frac{R69}{2B_0}$$

$$R64 = \frac{R69}{2K_1D_0}$$

$$R67 = \frac{R69}{2(2B_0 + K_1D_0)}$$

$$\frac{R69}{R68} = K_1$$

$$R66 = R69$$

The resistors associated with op-amp 273 should satisfy the following ratios:

$$R72 = R73$$

$$\frac{R74}{R72} = \frac{C_0}{K_1}$$

where $K_1$ should be chosen such that $K_1 \geqq 2C_0$. In a preferred embodiment, $K_1$ is equal to 0.4. As in most multi-stage analog circuits, the gain of a given signal path can be independently controlled at each stage. As a consequence, there is always a certain amount of flexibility as to what gain occurs where. The $K_1$ coefficient is one such degree of freedom which can be chosen according to convenience. The above constraint on $K_1$ is recommended for the sake of dynamic signal range in order prevent the output of op-amp 273 from saturating with maximum input signals on both input channels.

Figure 17:
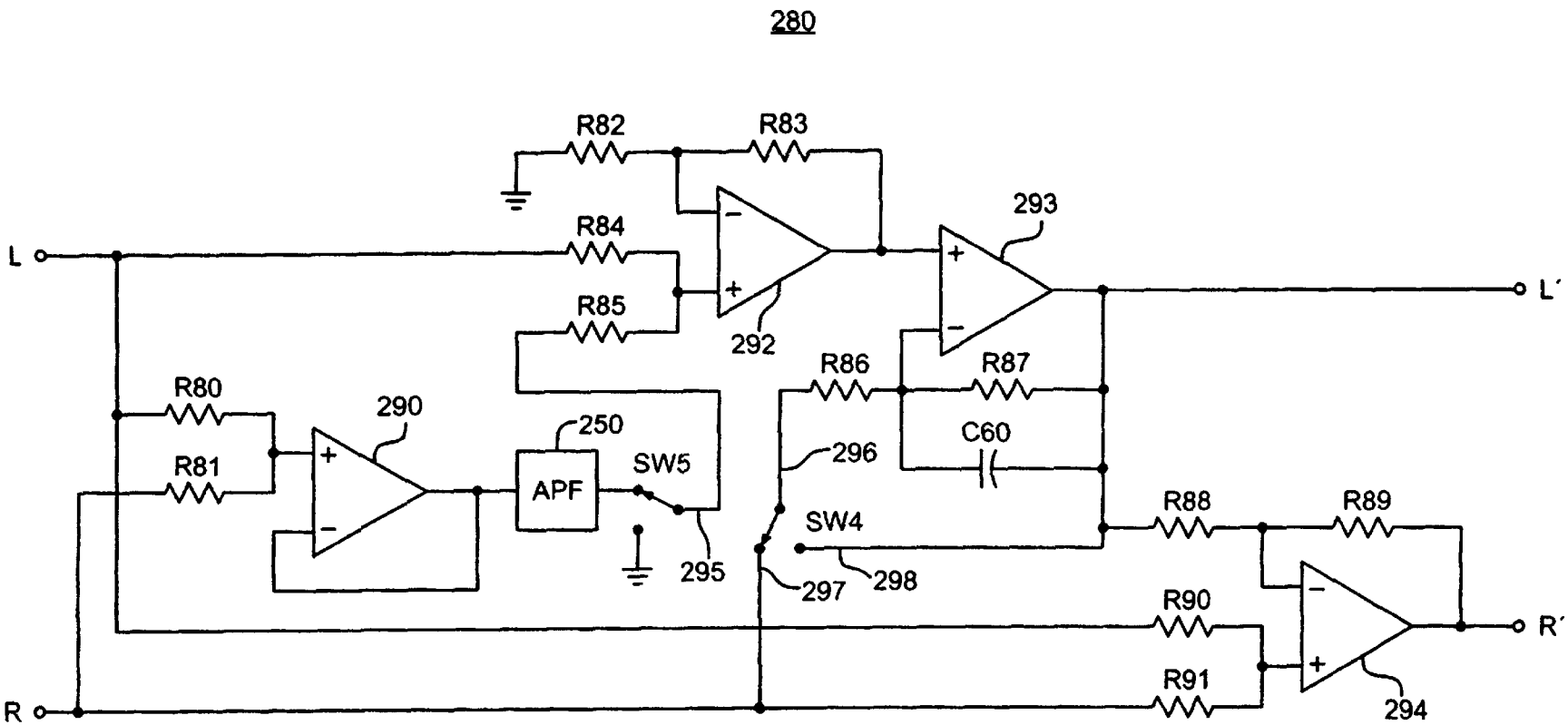

In another embodiment, a stereo/mono system 280 is disclosed below and illustrated in FIG. 17 which operates in accordance with the topology of FIG. 14. Accordingly, the discussion above with respect to the topology of FIG. 14 is equally applicable to stereo/mono system 280, where the left L' and right R' output signals are related to the left L and right R inputs signals according to Equation (11). The emulated D(s) transfer function is of the form previously stated with reference to the topology of FIG. 14, where $D_0$ is fixed at a maximum value such that:

$$D_0 = B_0 + 1$$

The stereo enhancement portion of system 280 is performed by op-amps 293, 294 and their respective associated capacitor C60 and resistors R86–R91, and thus implements the B(s) transfer function in a manner identical to stereo enhancement system 70 of FIG. 6. Pseudo-stereo enhancement is combined with stereo enhancement by summing the pseudo-stereo signal with the left input signal L before stereo enhancement is performed, as is discussed below.

Op-amp 290 and associated resistors R80–R81 sum and then scale by one-half the left L and right R inputs signals in order to extract the monophonic component (L+R) of the input source. Note that resistors R80 and R81 should be of equal value. This sum signal is filtered by filter 250 according to the C(s) transfer function to synthesize a pseudo-stereo signal. This pseudo-stereo signal is then summed with the left input signal L by op-amp 292 and associated resistors R82–R85. The gain of left input signal through op-amp 292 is unity, while the gain of the synthesized pseudo-stereo signal through op-amp 292 may be adjusted according to the desired depth of the pseudo-stereo effect. Accordingly, values for resistors R82–R85 should be chosen as follows:

$$2C_0 = \frac{R83}{R82} = \frac{R84}{R85}$$

System 280 includes two switches SW4 and SW5 which allow system 280 to switch, in a manner identical to that of system 260 of FIG. 16, between bypass, stereo-only enhancement, and stereo/mono enhancement modes. Thus, when switch SW5 connects line 295 to ground, the operating mode of system 280 is determined by position of switch SW4. If switch SW4 connects lines 296 and 297, system 280 operates in stereo-only mode. If switch SW4 connect lines 296 and 298, system 280 operates in bypass mode. System 280 operates in stereo/mono mode when switch SW4 connects lines 296, 297 and switch SW5 connects line 295 to the output of filter 250. As discussed above in reference to previous embodiments, the values of components contained in system 280 may vary depending upon design, component and performance considerations. However, the following constraints should be satisfied in order to realize the benefits of the embodiment of FIG. 17:

R80=R81

$\tau_p$=R87·C60

$$B_0 = \frac{R87}{R86}$$

R88=R89

R90=R91

The simpler design and lower implementation cost of system 280 as compared to system 260 is achieved by using both the inverting and non-inverting modes of the op-amps therein. Although utilizing both modes of the op-amps as such may adversely affect sound quality, any such degradation in acoustic quality will be slight and well within the performance requirements of many applications.

The topology of FIG. 14 can be implemented in an even simpler design allowing attenuation of the input signals. In accordance with another embodiment of the present invention, a stereo/mono enhancement system 300*a* is disclosed below and illustrated in FIG. 18 which requires only four op-amps. The input signals L and R are scaled by a factor $K_2$. The selection of an appropriate value of $K_2$ involves consideration of two factors as will be discussed shortly.

The pseudo-stereo portion of system 300*a* is formed by op-amps 310 and 311 and their associated resistors R100–R108 and capacitors C70–C72. Op-amp 310 first sums the left L and right R input signals, thereby extracting the monophonic component, and then filters this sum according to a single-pole all-pass filter. Op-amp 311 forms the core of a second order all-pass filter which also divides the sum signal by a factor $1+K_3$. Although somewhat dependent upon the pole frequencies, the value of $K_3$ should generally be close to unity in order to minimize sensitivity to component variation. Op-amps 312 and 313 form the stereo enhancement portion of system 300*a* and operate in a manner similar to stereo enhancement system 70 of FIG. 6. Resistors R109–R113 allow $D_0$ to vary between $B_0+1$ and 1. Resistor R119 matches the attenuation of the sum signal path to the rest of the circuit.

System 300*a* includes two switches SW4 and SW5 which allow system 300*a* to operate in either bypass, stereo only enhancement, or stereo/mono enhancement mode as previously described with respect to systems 260 and 280.

The selection of component values in system 300*a* is dictated by application requirements and component types.

The factors $K_2$ and $K_3$ can be selected to minimize the component sensitivity of the second order all-pass filter as well as to adjust the overall signal attenuation level. These two factors are constrained as follows:

$$C_0 = \frac{1}{2(1+K_3)}\left(\frac{1}{K_2} - 1\right)$$

In a preferred embodiment, $K_2$ and $K_3$ are equal to 0.667 and 0.25, respectively. The component values used in the pseudo-stereo portion should satisfy the following constraints:

$$R100 = R102 = \frac{1}{2}\,R101$$

$$R103 = R104$$

$$\tau_1 = \frac{1}{2}\,R103 \cdot C70$$

$$R106 \cdot C71 = \frac{2}{K_3}\,(\tau_2 + \tau_3)$$

$$R106 \cdot C72 = \frac{\tau_2\tau_3(\tau_2+\tau_3)}{\left(2 - \frac{K_3}{2}\right)\tau_2\tau_3 + \tau_2^2 + \tau_3^2}$$

$$\frac{R105}{R106} = \frac{K_3}{2}\left[1 - \frac{K_3}{2}\,\frac{\tau_2\tau_3}{(\tau_2+\tau_3)^2}\right]$$

$$\frac{R107}{R108} = K_3$$

Time constants $\tau_1$, $\tau_2$ and $\tau_3$ can be any permutation of recommended time constants for the C(s) function poles. The component values used in the stereo enhancement portion should satisfy the following constraints:

$$\tau_P = R114 \cdot C73$$

$$\frac{R109}{R110} = \frac{1}{K_2} - 1$$

$$\frac{R114}{R111} = (B_0 + 1 - D_0)(1 - K_2)$$

$$\frac{R114}{R112} = K_2 B_0$$

$$\frac{R114}{R113} = (D_0 - 1)(1 - K_2)$$

$$R115 = R116$$

$$R117 = R118$$

$$\frac{R117}{R119} = 2\left(\frac{1}{K_2} - 1\right)$$

Resistors R110–R113 provide more flexibility than may be needed for a given set of parameters. For instance, if a maximum value of $D_0$ is desired, then R111 should be omitted. If, on the other hand, $D_0$ is desired to equal 1, then R113 should be omitted. The complete set is shown for the sake of generality. It should be noted that the system 300*a* attenuates the input signals in all modes of operation, including bypass. Thus, the sum of output signals L' and R' will be the sum of input signals L and R multiplied by some constant factor.

It should be noted that most of the systems and topologies described above may be modified to have a gain other than unity by ensuring that the L and R signal paths have an equivalent attenuation or gain. Such modifications will become apparent to those skilled in the art after reading this disclosure.

Figure 18:
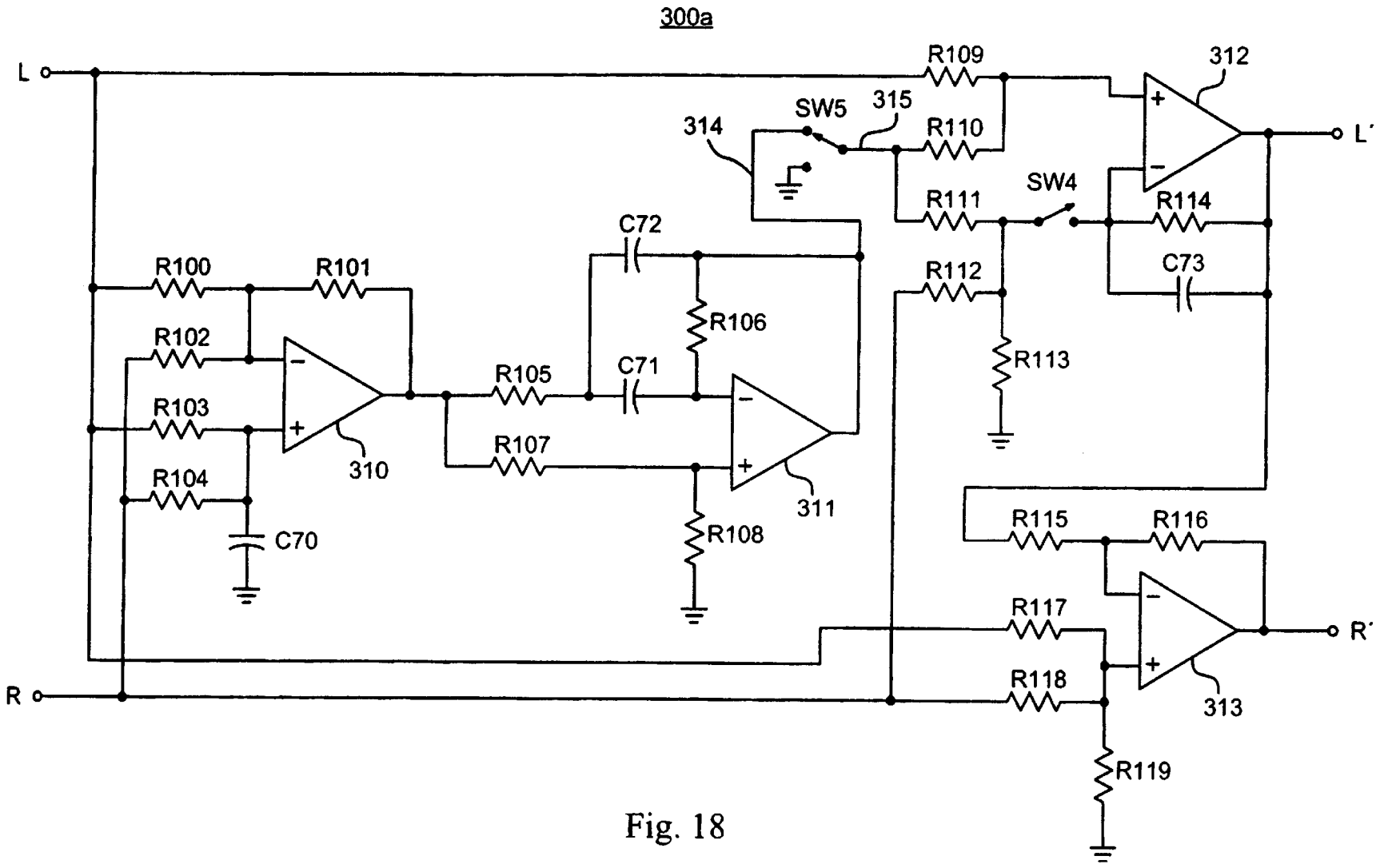
Figure 19:
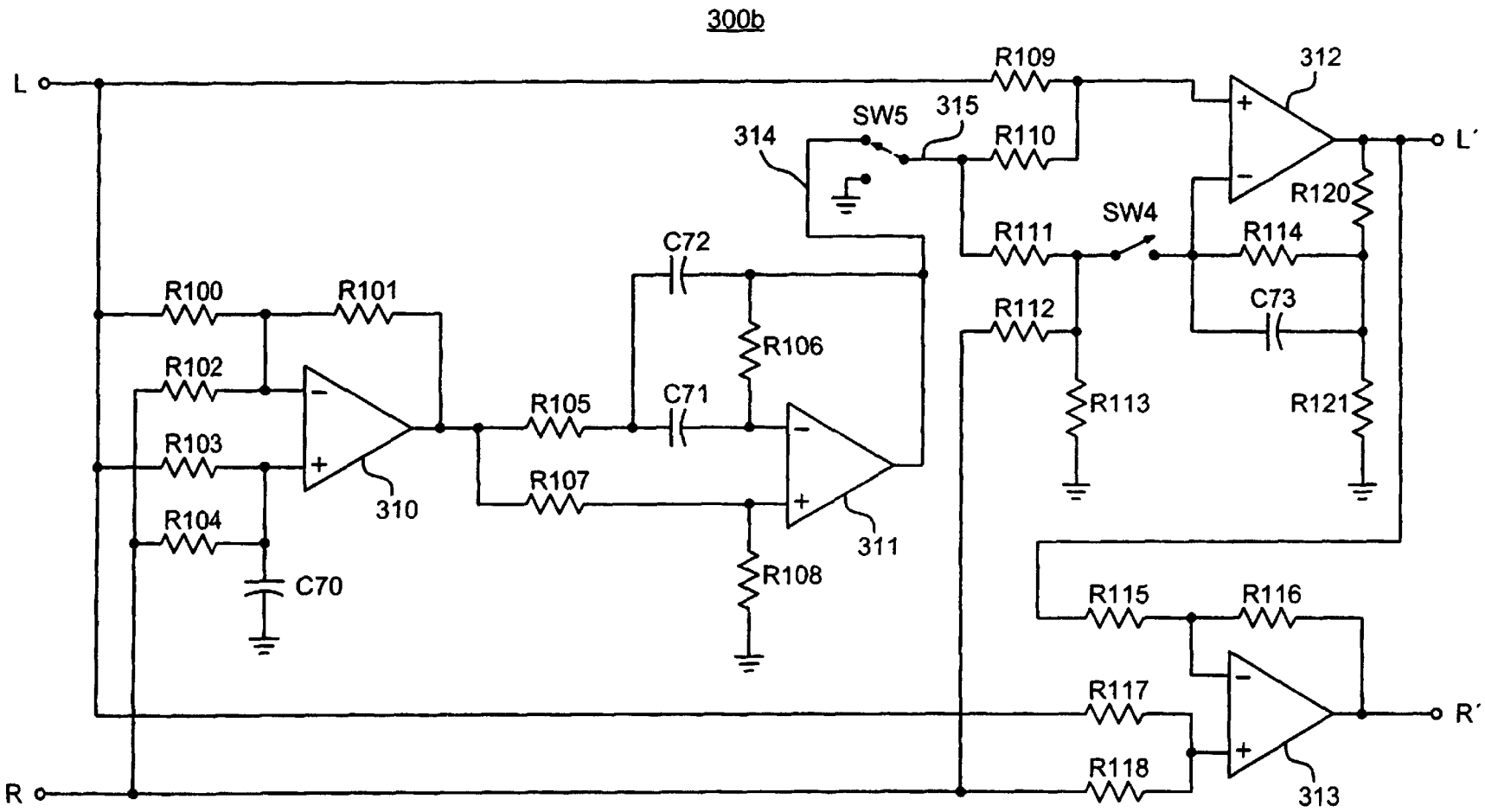

System 300*a* of FIG. 18 may be modified to have no signal attenuation by slightly compromising the stereo enhancement transfer function B(s). The resultant structure, embodied as stereo/mono enhancement system 300*b*, is illustrated in FIG. 19. System 300*b* is identical to and operates in the same manner as system 300*a* of FIG. 18 except for the deletion of resistor R119 and the addition of resistors R120–R121. In order to ensure unity gain in bypass mode and no attenuation in the stereo only and stereo/mono enhancement modes, the following constraint should be met:

$$\frac{R109}{R110} = \frac{R120}{R121}$$

System 300*b* will operate according to a modified enhancement transfer function B'(s) which from the previously defined B(s) transfer function as follows:

$$B'(s) = B(s) + \frac{\frac{1}{R111} + \frac{1}{R112} + \frac{1}{R113}}{\frac{1}{R120} + \frac{1}{R121}} = B(s) + K_4$$

where $K_4$ is of a value such that:

$$K_4\left(\frac{1}{R120} + \frac{1}{R121}\right) = \frac{1}{R111} + \frac{1}{R112} + \frac{1}{R113}$$

Although it is desirable for the error factor $K_4$ to be as small as possible, minimizing $K_4$ must be balanced with practicality of either maximizing resistors R111–R113 or minimizing resistors R120–R121. Applicant has found that a value of 0.1 for $K_4$ is fairly easily realized and produces a sound quality virtually indistinguishable from systems operating without such an error factor. This result may be objectively verified by considering that the error factor $K_4$ comprises a significant portion of the B'(s) transfer function only at higher frequencies and, even then, constitutes only a small fraction of the output signal power.

Figure 20:
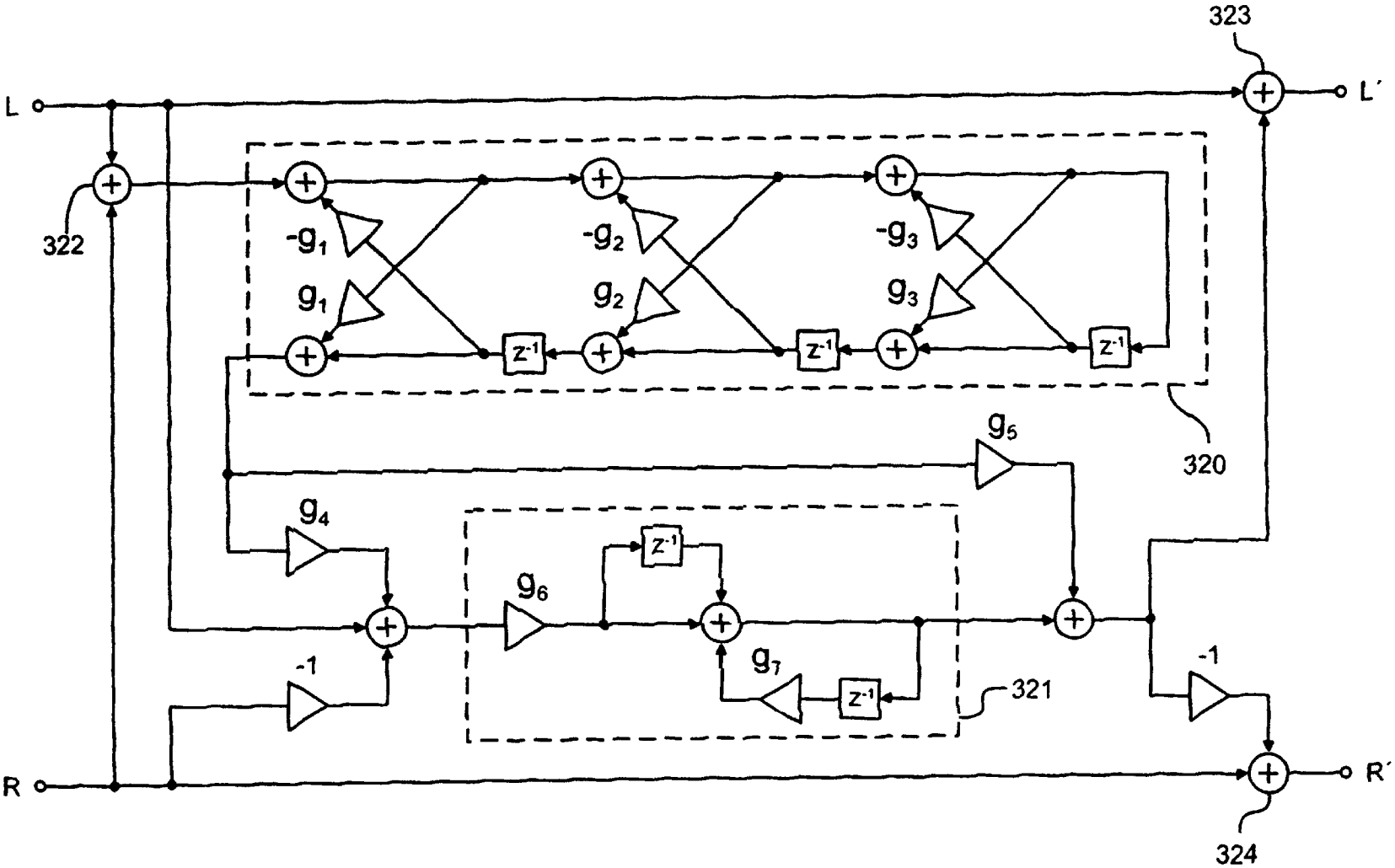
FIG. 20 is a block diagram of a topology for implementing some of the stereo/mono topologies of the present invention in a digital signal processor.

All of the above described stereo/mono systems may be mapped into the discrete-time digital signal processing domain using the bilinear transform mentioned earlier. A digital implementation is quite useful to allow a user to dynamically adjust parameter values. By way of example, the topology of FIG. 12 may be digitally implemented as follows. FIG. 20 illustrates a complete data flow diagram for a DSP implementation based upon the topology of FIG. 12. Block 320 forms a three-stage all-pass filter, which is equivalent to the C(s) transfer function normalized to a unity magnitude gain. Block 321 performs the B(s) transfer function. Multiplier factor $g_5$ accounts for the factor $C_0$ which is not present in the all-pass filter block 320. Similarly, multiplier factor $g_4$ is scaled by $C_0$. Note that gain multiplications can be rearranged in the signal flow without affecting functionality. In the preferred implementation the multiplier factors should be chosen as follows:

$g_1$=−0.991495
$g_2$=0.894378
$g_3$=−0.392830
$g_4$=1.440000
$g_5$=0.200000
$g_6$=0.057956
$g_7$=0.962908

This implementation thus requires only seven multiplier coefficients and only five delay storage elements. Note that the architecture of the particular DSP used may require modifications to the signal flow diagram of FIG. 20. For instance, if the DSP uses fixed-point arithmetic with a small word size, scaling might be required to avoid saturation at nodes such as those at the output of block 321 and the output of adder 322. In architectures in which multiply-accumulate operations are as economical to implement as are simple addition or multiplication, it may be advantageous to rearrange the multiplication operations so as to pair with addition operations. Such issues, as well as the DSP implementation of specific embodiments of the present invention, are well understood in the art.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method for spatially enhancing a two-channel input signal which may be either a monophonic signal or a stereophonic signal, said method comprising the steps of:

enhancing said input signal using a sum-invariant stereo enhancement circuit to produce a two-channel stereo-enhanced signal;

creating a sum signal from said input signal;

phase-shifting said sum signal to create an enhanced sum signal; and combining said enhanced sum signal with said two-channel stereo-enhanced signal to produce a two-channel output signal.

2. The method of claim 1 wherein said step of combining farther comprises summing said enhanced sum signal with a first channel of said stereo-enhanced signal to produce a first channel of said output signal and subtracting said enhanced sum signal from a second channel of said stereo-enhanced signal to produce a second channel of said output signal.

3. The method of claim 1, wherein said step of enhancing further comprises creating a difference signal from said input signal, said two-channel enhanced stereo signal being created from said difference signal using said sum-invariant stereo enhancement circuit.

4. A method for enhancing an input signal comprising first and second input channels to produce a spatially enhanced output signal comprising first and second output channels, said method comprising the steps of:

generating a sum signal in response to said first and second input channels;

generating a difference signal in response to said first and second input channels;

enhancing said sum signal using a first filter to produce an enhanced sum signal;

enhancing said difference signal using a second filter to produce an enhanced difference signal;

summing said enhanced sum signal and said enhanced difference signal to produce an intermediate signal;

summing said intermediate signal with said sum signal to produce said first output channel; and subtracting said intermediate signal from said sum signal to produce said second output channel.

5. The method of claim 4 wherein said first filter comprises an all-pass filter.

* * * * *